US009614284B2

(12) United States Patent
Ban et al.

(10) Patent No.: US 9,614,284 B2
(45) Date of Patent: Apr. 4, 2017

(54) FREQUENCY CHARACTERISTIC ADJUSTING JIG, ANTENNA TESTING APPARATUS AND ANTENNA TESTING METHOD, AND LOOP ANTENNA

(71) Applicant: FUJITSU LIMITED, Kawasaki-shi, Kanagawa (JP)

(72) Inventors: Yasumitsu Ban, Yokohama (JP); Manabu Kai, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/797,472

(22) Filed: Jul. 13, 2015

(65) Prior Publication Data

US 2016/0093953 A1 Mar. 31, 2016

(30) Foreign Application Priority Data

Sep. 30, 2014 (JP) ..... 2014-202508

(51) Int. Cl.
*H01Q 11/12* (2006.01)
*H01Q 7/00* (2006.01)
*H01Q 1/22* (2006.01)

(52) U.S. Cl.
CPC ..... *H01Q 7/00* (2013.01); *H01Q 1/2225* (2013.01); *H01Q 7/005* (2013.01)

(58) Field of Classification Search
CPC ..... H01Q 7/00; H01Q 1/38; H01Q 9/0421; H01Q 5/321; H01Q 21/24
USPC ..... 343/744, 743, 788, 870, 866
See application file for complete search history.

(56) References Cited

U.S. PATENT DOCUMENTS 3,778,836 A * 12/1973 Tanaka ..... H01Q 7/08 343/702
4,940,992 A * 7/1990 Nguyen ..... H01Q 1/243 343/702
5,945,959 A * 8/1999 Tanidokoro ..... H01Q 1/38 343/700 MS (Continued)

FOREIGN PATENT DOCUMENTS

EP 2408065 A2 1/2012
JP 2001-160124 6/2001

(Continued)

OTHER PUBLICATIONS

EESR—The Extended European Search Report issued for European Patent Application No. 15176708.4 dated Feb. 16, 2016.

*Primary Examiner* — Linh Nguyen
(74) *Attorney, Agent, or Firm* — Fujitsu Patent Center

(57) ABSTRACT

A frequency characteristic adjusting jig attached to a loop antenna includes: a conductive first member which is located along an outer periphery of a loop for a portion of a conductor forming the loop antenna, and which is electromagnetically coupled or electrically connected to the portion of the conductor; a conductive second member which is located along the outer periphery of the loop for another portion of the conductor, and which is electromagnetically coupled or electrically connected to the other portion of the conductor; and a conductive third member which connects the first and second members together via a different path than a path formed along the loop. The first and second members are chosen to have a length along the loop such that a frequency characteristic of the loop antenna is shifted according to the length.

13 Claims, 17 Drawing Sheets

(56) References Cited

U.S. PATENT DOCUMENTS

| | | | | |
|---|---|---|---|---|
| 5,995,054 | A * | 11/1999 | Massey | H01Q 7/005 343/743 |
| 8,576,124 | B2 * | 11/2013 | Popugaev | G06K 19/07749 343/700 MS |
| 2004/0075607 | A1 | 4/2004 | Cathey | |
| 2005/0248488 | A1 * | 11/2005 | Modro | H01Q 1/38 343/700 MS |
| 2007/0120758 | A1 * | 5/2007 | Takahashi | G04G 21/04 343/788 |
| 2010/0171676 | A1 | 7/2010 | Tani et al. | |
| 2013/0002501 | A1 * | 1/2013 | Li | H01Q 5/35 343/767 |
| 2014/0021265 | A1 | 1/2014 | Kai et al. | |
| 2014/0085161 | A1 * | 3/2014 | Zhu | H01Q 1/243 343/867 |
| 2014/0194069 | A1 * | 7/2014 | Liu | H04B 17/29 455/67.14 |
| 2014/0197832 | A1 | 7/2014 | Driesel et al. | |
| 2014/0340281 | A1 * | 11/2014 | Chang | H01Q 1/22 343/906 |
| 2016/0043466 | A1 * | 2/2016 | Tao | H01Q 5/10 343/726 |

FOREIGN PATENT DOCUMENTS

| | | |
|---|---|---|
| WO | 2012/137330 | 10/2012 |
| WO | 2013/013680 A1 | 1/2013 |

* cited by examiner

FREQUENCY CHARACTERISTIC ADJUSTING JIG, ANTENNA TESTING APPARATUS AND ANTENNA TESTING METHOD, AND LOOP ANTENNA

CROSS-REFERENCE TO RELATED APPLICATION

This application is based upon and claims the benefit of priority of the prior Japanese Patent Application No. 2014-202508, filed on Sep. 30, 2014, the entire contents of which are incorporated herein by reference.

FIELD

The embodiments discussed herein are related to a frequency characteristic adjusting jig used for adjusting the frequency characteristic of a loop antenna, an antenna testing apparatus and antenna testing method using such a jig, and a loop antenna.

BACKGROUND

Loop antennas are one of various kinds of antennas known in the art. A loop antenna is a type of antenna that is constructed by forming a conductor in the shape of a loop and that causes the conductor to operate as a coil. A method for adjusting the frequency characteristic of such a loop antenna is proposed in order to enable the loop antenna to transmit or receive a radio wave of a desired frequency (for example, refer to Japanese Laid-open Patent Publication No. 2001-160124 and International Publication WO 2012/137330).

For example, Japanese Laid-open Patent Publication No. 2001-160124 discloses a method which places, in the vicinity of an antenna forming a resonant circuit, a closed loop antenna or a conductor such as a metal plate or another resonant circuit in order to adjust the inductance of the antenna and thereby adjust the resonant frequency of the resonant circuit.

On the other hand, International Publication WO 2012/137330 proposes a metal sheet which is attached to a noncontact communication tag in order to maximize the communication distance at a desired frequency. The metal sheet includes a first metal part and a second metal part disposed at positions symmetrical about the center of the metal sheet, and is attached to the tag so that a portion of the first metal part and a portion of the second metal part respectively contact the tag.

SUMMARY

It is also known to provide a loop antenna having a three-dimensional shape such that the width of the conductor forming the loop, measured in a direction perpendicular to the plane of the loop, is larger than the width of the conductor measured in the plane of the loop. However, the techniques disclosed in the above cited Japanese Laid-open Patent Publication No. 2001-160124 and International Publication WO 2012/137330 are for adjusting the frequency characteristic of a loop antenna formed in a two-dimensional shape, and neither of them can be applied to a loop antenna having a three-dimensional shape.

According to one embodiment, a frequency characteristic adjusting jig to be attached to a loop antenna including a conductor that is formed in the shape of a loop such that a width measured in a direction perpendicular to a plane of the loop is larger than a width measured in the plane of the loop and that includes a feed point formed in a portion of the loop is provided. The frequency characteristic adjusting jig includes: a conductive first member which, when the frequency characteristic adjusting jig is attached to the loop antenna, is located along an outer periphery of the loop for a portion of the conductor and is electromagnetically coupled or electrically connected to the portion of the conductor; a conductive second member which, when the frequency characteristic adjusting jig is attached to the loop antenna, is located along the outer periphery of the loop for another portion of the conductor and is electromagnetically coupled or electrically connected to the other portion of the conductor; and a conductive third member which connects the first and second members together via a different path than a path formed along the loop. The first and second members are chosen to have a length along the loop such that a frequency characteristic of the loop antenna is shifted according to the length.

According to another embodiment, a loop antenna is provided. The loop antenna includes: a conductor which is formed in the shape of a loop such that a width measured in a direction perpendicular to a plane of the loop is larger than a width measured in the plane of the loop, and which includes a feed point formed in a portion of the loop; a conductive first member which is located along an outer periphery of the loop for a portion of the conductor, and which is electromagnetically coupled or electrically connected to the portion of the conductor; a conductive second member which is located along the outer periphery of the loop for another portion of the conductor, and which is electromagnetically coupled or electrically connected to the other portion of the conductor; and a conductive third member which connects the first and second members together via a different path than a path formed along the loop. The first and second members are chosen to have a length along the loop such that a frequency characteristic of the loop antenna is shifted according to the length.

According to still another embodiment, an antenna testing apparatus for testing a loop antenna including a conductor that is formed in the shape of a loop such that a width measured in a direction perpendicular to a plane of the loop is larger than a width measured in the plane of the loop and that includes a feed point formed in a portion of the loop is provided. The antenna testing apparatus includes: a frequency characteristic adjusting jig to be attached to the loop antenna; a measuring unit which radiates, toward the loop antenna to which the frequency characteristic adjusting jig is attached, a radio wave having a second frequency different from a first frequency at which the loop antenna is designed to operate, and thereby measures a metric relating to communication performance of the loop antenna at the second frequency; and a testing unit which obtains a test result of the loop antenna based on the metric.

The frequency characteristic adjusting jig includes: a conductive first member which, when the frequency characteristic adjusting jig is attached to the loop antenna, is located along an outer periphery of the loop for a portion of the conductor and is electromagnetically coupled or electrically connected to the portion of the conductor; a conductive second member which, when the frequency characteristic adjusting jig is attached to the loop antenna, is located along the outer periphery of the loop for another portion of the conductor and is electromagnetically coupled or electrically connected to the other portion of the conductor; and a conductive third member which connects the first and second members together via a different path than a path formed along the loop, wherein the first and second members are chosen to have a length along the loop such that a frequency characteristic of the loop antenna is shifted from the first frequency to the second frequency.

The object and advantages of the invention will be realized and attained by means of the elements and combinations particularly indicated in the claims.

It is to be understood that both the foregoing general description and the following detailed description are exemplary and explanatory and are not restrictive of the invention, as claimed.

DESCRIPTION OF EMBODIMENTS

A frequency characteristic adjusting jig for a loop antenna and a loop antenna frequency characteristic testing apparatus and a loop antenna frequency characteristic testing method using such a frequency characteristic adjusting jig will be described below with reference to the drawings.

Figure 1:
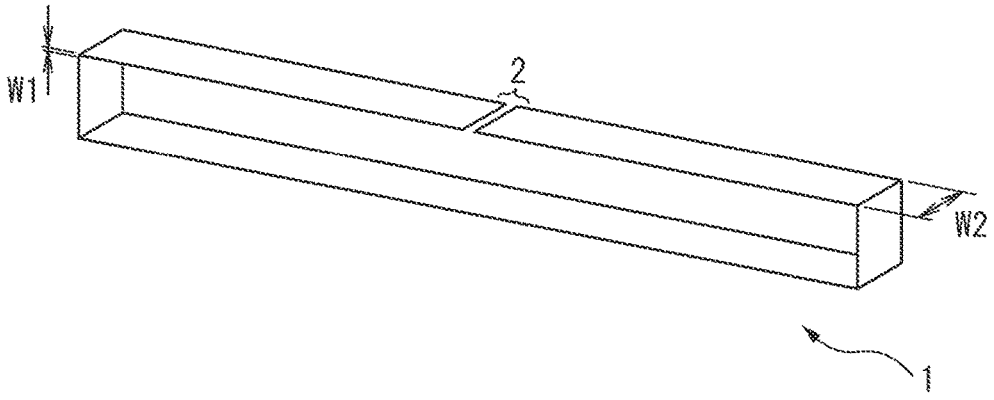
FIG. 1 is a schematic perspective view illustrating one example of a loop antenna whose frequency characteristic is to be adjusted.

FIG. 1 is a schematic perspective view illustrating one example of a loop antenna whose frequency characteristic is to be adjusted. The loop antenna 1 is a plate-like conductor such as copper or gold formed into the shape of a loop by bending the conductor across its widthwise direction, for example, at four places. The loop antenna 1 is rectangular in shape having two long sides and two short sides in the plane of the loop. Further, the conductor forming the loop antenna 1 has a width W1 in the plane of the loop, which is smaller than the width W2 measured in a direction perpendicular to the plane of the loop. As a result, the loop antenna 1 has a three-dimensional shape.

A feed point 2 is provided at the center of one of the long sides of the loop antenna 1. The loop antenna 1 is electrically connected via the feed point 2 to a signal processing circuit (not depicted) which processes a signal superimposed on a radio wave received or radiated by the loop antenna 1. The loop antenna 1 is used to communicate with a communication device placed so as to face the long side provided with the feed point 2 with a prescribed gap provided therebetween. The outer periphery of the loop antenna 1 may be enclosed by a supporting member (not depicted) that is formed from a dielectric and supports the loop antenna 1. The interior of the loop of the loop antenna 1 may also be filled with a dielectric.

The loop antenna 1 is used, for example, as an antenna of a radio frequency identifier (RFID) tag. It is therefore preferable to form the loop antenna 1 compact in size. Therefore, the length of the conductor along the loop, for example, is made shorter than one half of the wavelength of the radio wave corresponding to the frequency at which the loop antenna 1 is designed to operate.

Figure 2A:
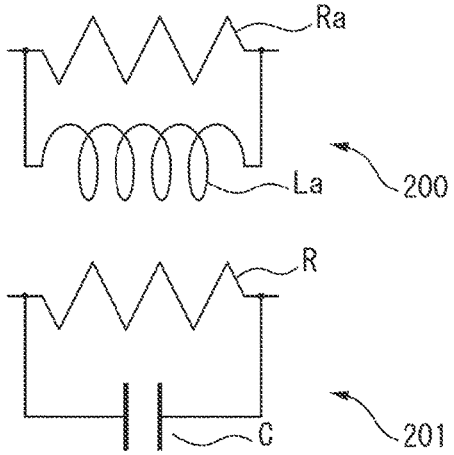
FIG. 2A is an equivalent circuit diagram of the loop antenna depicted in FIG. 1.

FIG. 2A is an equivalent circuit diagram of the loop antenna depicted in FIG. 1. The loop antenna 1 is represented by an equivalent circuit 200 which is a parallel connection of a resistor Ra and a coil La. On the other hand, the signal processing circuit connected via the feed point 2 to the loop antenna 1 is represented by an equivalent circuit 201 which is a parallel connection of a resistor R and a capacitor C. When the impedance of the equivalent circuit 200 to a radio wave having a designated frequency matches the impedance of the equivalent circuit 201, the loop antenna 1 can pass the received radio wave to the signal processing circuit. In other words, the loop antenna 1 can be used for radio waves that fall within a prescribed frequency range centered about the designated frequency.

The inductance component of the coil La in the equivalent circuit 200 varies with the length of the loop of the loop antenna 1, i.e., the length of the path along which the current flows. More specifically, the shorter the loop of the loop antenna 1, the smaller is the inductance component of the coil La. As a result, the radio wave frequency at which the impedance of the equivalent circuit 200 matches the impedance of the equivalent circuit 201 becomes higher. For convenience of explanation, the inductance component of the coil La will hereinafter be referred to as the parallel inductance component.

Figure 2B:
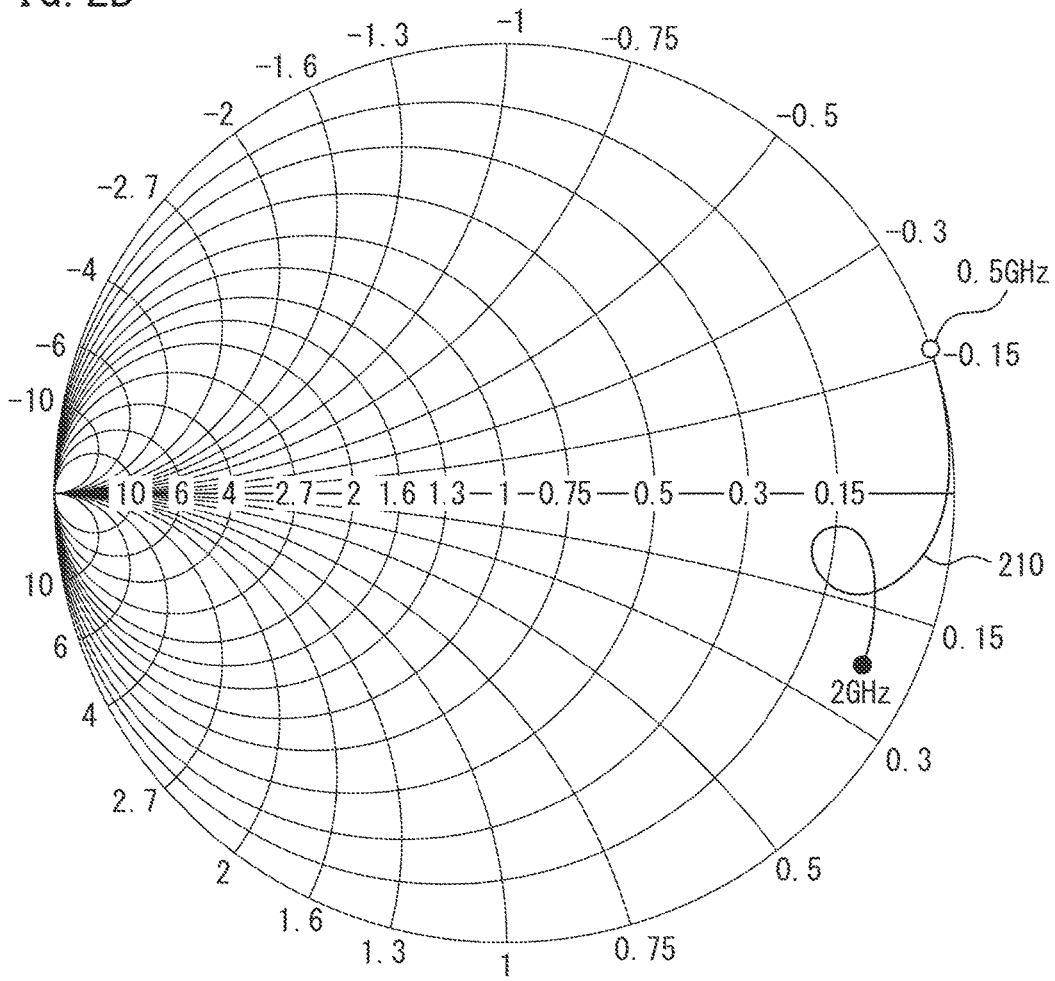
FIG. 2B is a Smith chart indicating the relationship between the parallel inductance component of the loop antenna of FIG. 1 and a frequency.

FIG. 2B is a Smith chart indicating the relationship between the parallel inductance component of the loop antenna 1 and a frequency. In FIG. 2, the Smith chart is normalized to 50 Ω. Each Smith chart to be described hereinafter is also normalized to 50 Ω. A curve 210 describes the parallel inductance component of the loop antenna 1 at frequencies of 0.5 GHz to 2 GHz. The loop antenna 1 can be used in the range of frequencies at which the impedance corresponding to the value of the parallel inductance component described by the curve 210 matches the impedance of the signal processing circuit. By adjusting the parallel inductance component, the impedance of the loop antenna 1 can be changed. This means that when the parallel inductance component is adjusted, the range of frequencies at which the loop antenna 1 can be used also changes.

The frequency characteristic adjusting jig includes conductive members which are disposed along the outer periphery of the loop so as to be electromagnetically coupleable to the respective long sides of the loop antenna 1, and shortens the path of the current flowing through the loop antenna 1 by electrically short-circuiting these members. The length of the frequency characteristic adjusting jig along the loop of the loop antenna is adjusted to the length that matches the amount by which to shift the frequency characteristic. The frequency characteristic adjusting jig is thus used to adjust the frequency characteristic of the loop antenna 1. In the present application, the frequency characteristic of the loop antenna is defined as the relationship between the frequency and the metric relating to the communication performance of the loop antenna (for example, communicable range, etc.).

Figure 3:
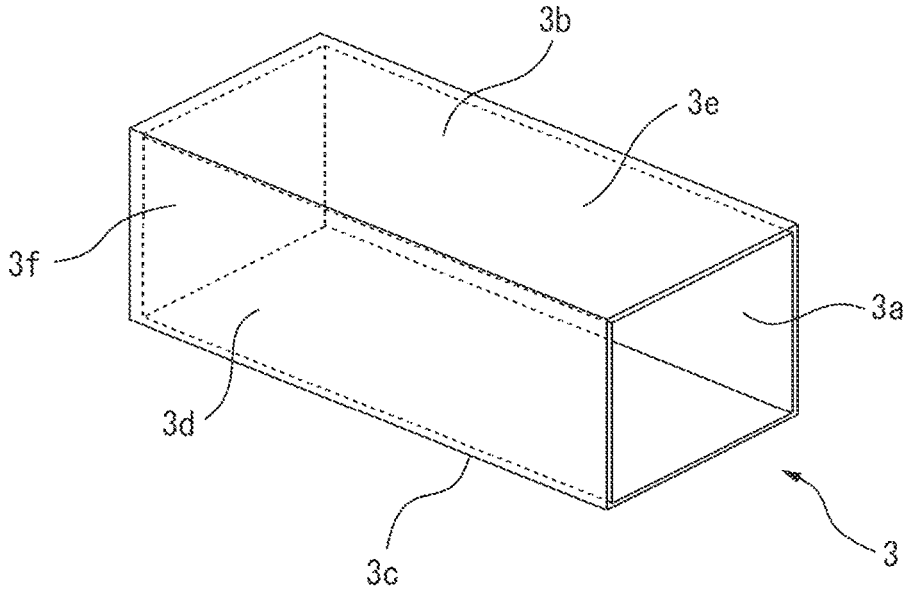
FIG. 3 is a schematic perspective view of a frequency characteristic adjusting jig according to one embodiment.

FIG. 3 is a schematic perspective view of a frequency characteristic adjusting jig according to one embodiment. As illustrated in FIG. 3, the frequency characteristic adjusting jig 3 is a hollow rectangular parallelepiped formed from a conductor such as copper or gold, and one of the faces of the rectangular parallelepiped is an open end 3*a* through which the loop antenna 1 is inserted.

Of the four faces bounding the open end 3*a*, two opposing faces 3*b* and 3*c* are examples of first and second members, respectively, each of which is electromagnetically coupled or electrically connected to a designated portion of the loop antenna 1. When the loop antenna 1 is inserted in the frequency characteristic adjusting jig 3, the faces 3*b* and 3*c* are located along the outer periphery of the loop of the loop antenna 1 so as to face the respective long sides. Accordingly, the spacing between the two faces 3*b* and 3*c* is equal to the length of the short side of the loop antenna 1 plus an offset (for example, 0.1 mm to 1 mm). On the other hand, of the four faces bounding the open end 3*a*, the two opposing faces 3*d* and 3*e* adjoining the faces 3*b* and 3*c* are one example of a third member for electrically connecting the first and second members to each other, and electrically connect the faces 3*b* and 3*c* to each other. Accordingly, the spacing between the two faces 3*d* and 3*e* is equal to the width of the conductor forming the loop of the loop antenna 1 plus an offset. If the loop of the loop antenna 1 is covered by a dielectric supporting member, then the spacing between the two faces 3*b* and 3*c* is equal to the length of the short side of the supporting member plus an offset. Likewise, the spacing between the two faces 3*d* and 3*e* is equal to the length of the supporting member in the width direction of the conductor forming the loop plus an offset (the same applies to the spacing in any other direction that is affected by the thickness of the supporting member when the loop antenna 1 is inserted in the frequency characteristic adjusting jig 3). The face 3*f* located at the end opposite from the open end 3*a* is one example of a fourth member, and is formed so as to face the short side of the loop antenna 1 when the loop antenna 1 is inserted in the frequency characteristic adjusting jig 3.

The frequency characteristic adjusting jig 3 may also include a dielectric supporting member which covers all or some of the faces 3*b* to 3*f*. In this case also, the spacing between opposing faces and the length of each face in any direction that is affected by the thickness of the supporting member of the frequency characteristic adjusting jig 3 when the loop antenna 1 is inserted in the frequency characteristic adjusting jig 3 are each equal to the length of the corresponding portion of the loop antenna 1 plus an offset corresponding to the thickness of the supporting member.

Figure 4:
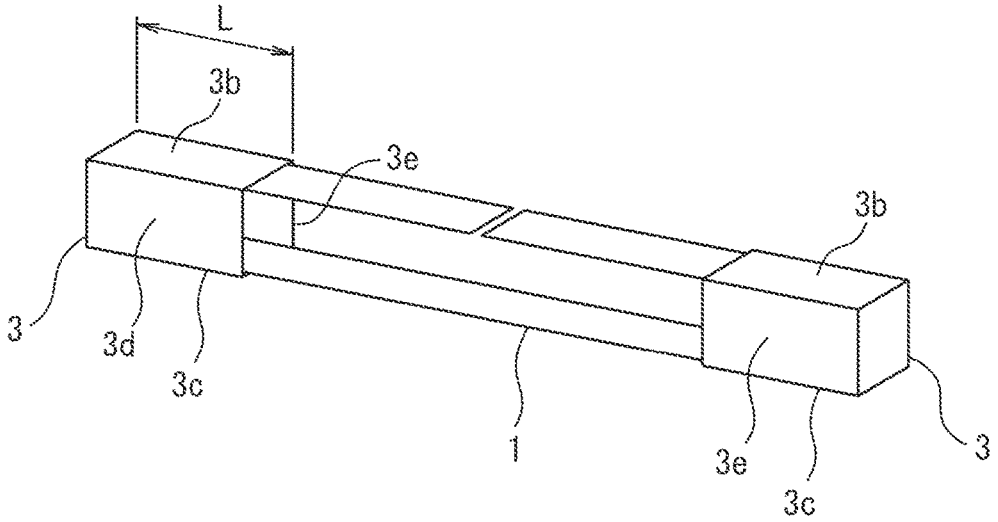
FIG. 4 is a schematic perspective view of the loop antenna which is equipped at each long side end with the frequency characteristic adjusting jig depicted in FIG. 3.

FIG. 4 is a schematic perspective view of the loop antenna 1 which is equipped at each long side end with the frequency characteristic adjusting jig 3 depicted in FIG. 3. As illustrated in FIG. 4, two frequency characteristic adjusting jigs 3 are attached to the loop antenna 1 by inserting both ends of the two long sides of the loop antenna 1 into the respective frequency characteristic adjusting jigs 3. As a result, the face 3*b* of each frequency characteristic adjusting jig 3 is electromagnetically coupled to one long side of the loop, while the face 3*c* of each frequency characteristic adjusting jig 3 is electromagnetically coupled to the other long side of the loop. Further, the face 3*f* of each frequency characteristic adjusting jig 3 is electromagnetically coupled to one short side of the loop of the loop antenna 1. In this way, a current path leading from the face 3*b* of each frequency characteristic adjusting jig 3 to the face 3*c* via the face 3*d* or 3*e* is formed between the two long sides of the loop of the loop antenna 1. As a result, the frequency characteristic of the loop antenna 1 varies with the length L of the frequency characteristic adjusting jig 3 measured along the long side of the loop antenna 1, i.e., the length of the portion of the loop antenna 1 inserted in the frequency characteristic adjusting jig 3.

Figure 5:
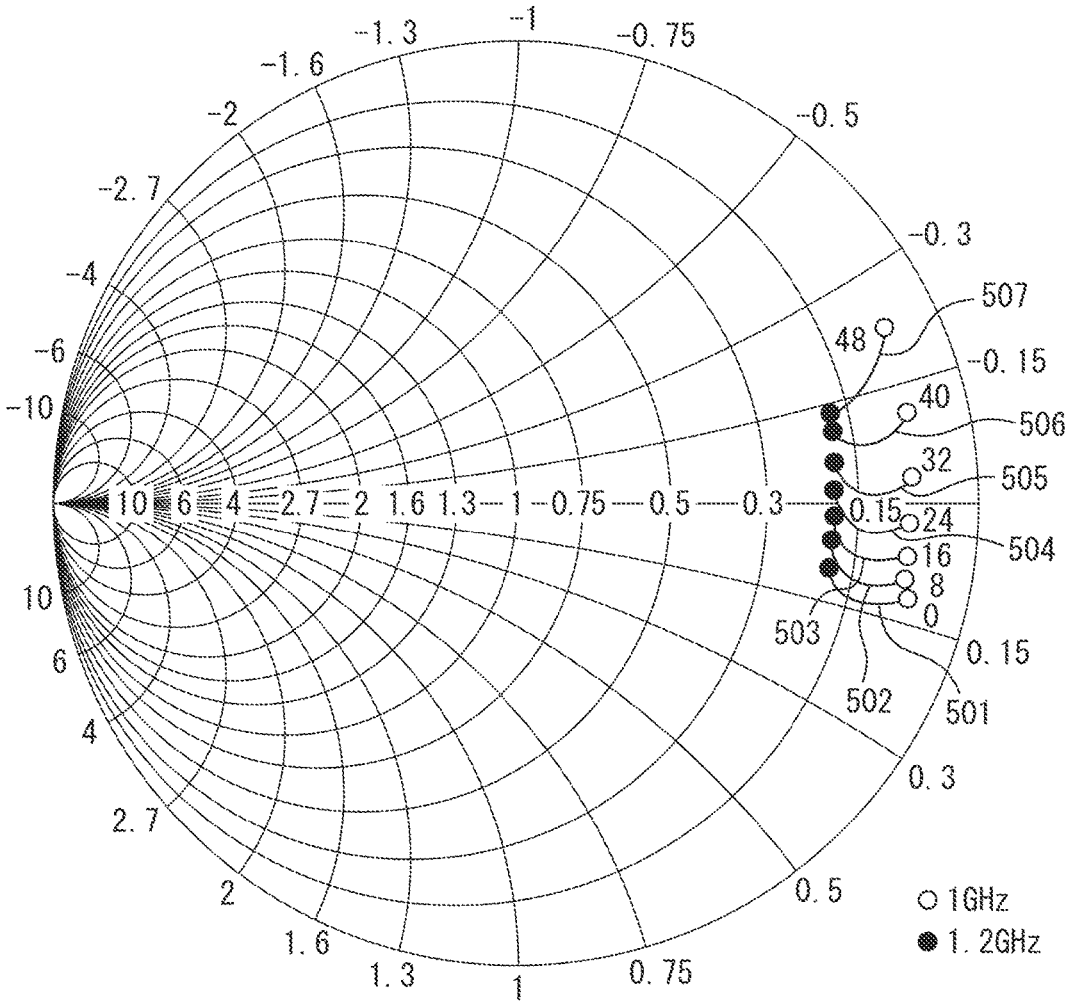
FIG. 5 is a Smith chart illustrating the relationship between the length of the frequency characteristic adjusting jig along the long side of the loop antenna and the frequency characteristic of the loop antenna.

FIG. 5 is a Smith chart, obtained by electromagnetic field simulation, that defines the relationship between the length L of the frequency characteristic adjusting jig 3 along the long side of the loop antenna 1 and the parallel inductance component of the loop antenna 1. In this simulation, it is assumed that the length along the long side of the loop of the loop antenna is 99.6 mm and the length along the short side is 10 mm. It is also assumed that the width of the conductor forming the loop, measured in a direction perpendicular to the plane of the loop, is 10 mm. Further, it is assumed that the loop antenna 1 is covered with a dielectric. More specifically, it is assumed that a dielectric whose thickness is such that the frequency characteristic adjusting jig 3 can be electromagnetically coupled to the conductor forming the loop of the loop antenna 1 exists between the frequency characteristic adjusting jig 3 and the conductor forming the loop of the loop antenna 1. In this electromagnetic field simulation, it is assumed that the relative permittivity of the dielectric is 1 and that the thickness of the dielectric between each long side of the loop antenna 1 and the face of the frequency characteristic adjusting jig 3 that faces or is adjacent to the long side is 0.4 mm. Further, it is assumed that the thickness of the dielectric between the short side of the loop antenna 1 and the face of the frequency characteristic adjusting jig 3 that faces the short side is 0.1 mm. The dimensions and physical properties of the loop antenna 1 and the dielectric used in this simulation are also used in the electromagnetic field simulation for the frequency characteristic adjusting jig according to each embodiment or modified example to be described hereinafter.

In FIG. 5, curves 501 to 507 describe the parallel inductance component at frequencies of 1 GHz to 1.2 GHz when the length L of the two frequency characteristic adjusting jigs 3 along the long side of the loop antenna 1 is set to 0 mm, 8 mm, 16 mm, 24 mm, 32 mm, 40 mm, and 48 mm, respectively. As can be seen from the curves 501 to 507, the longer the length L, the smaller is the parallel inductance component at frequencies of 1 GHz to 1.2 GHz.

For example, in the case of a loop antenna of an RFID tag that uses a signal processing circuit (chip) whose impedance is not 50 Ω, the characteristic is such that the frequency becomes higher in the clockwise direction in the Smith chart depicted in FIG. 2B. If it is assumed that R=1750 [Ω] and C=1 [pF] in the signal processing circuit and Ra of the loop antenna 1 is 1750 [Ω], then the condition for matching the impedance of the signal processing circuit to the impedance of the loop antenna 1 at a frequency of 880 MHz is given by La=32.7 [nH]. Similarly, the condition for matching the impedance of the signal processing circuit to the impedance of the loop antenna 1 at a frequency of 900 MHz is given by La=31.3 [nH]. Further, the condition for matching the impedance of the signal processing circuit to the impedance of the loop antenna 1 at a frequency of 920 MHz is given by La=29.9 [nH]. Accordingly, when the loop antenna 1 and the signal processing circuit can be described by the respective equivalent circuits given in FIG. 2A, the parallel inductance component of the loop antenna 1 equipped with the two frequency characteristic adjusting jigs 3 becomes smaller as the length L increases. Then, the frequency characteristic of the loop antenna 1 equipped with the two frequency characteristic adjusting jigs 3 shifts toward higher frequencies as the parallel inductance component decreases.

In the following description also, the frequency characteristic of the loop antenna 1 will be described by assuming the case where the loop antenna 1 is used in conjunction with the signal processing circuit that can be described by the equivalent circuit depicted in FIG. 2A.

Thus, it can be seen that by preparing in advance a plurality of frequency characteristic adjusting jigs 3 differing in length L, the frequency characteristic of the loop antenna 1 can be adjusted according to the number of frequency characteristic adjusting jigs 3 used. When the faces 3*b* and 3*c* of the frequency characteristic adjusting jig 3 are electrically connected to the respective long sides of the loop of the loop antenna 1 by directly contacting them, the change of the parallel inductance component with respect to the change of the length L becomes larger than that depicted in FIG. 5.

Figure 6:
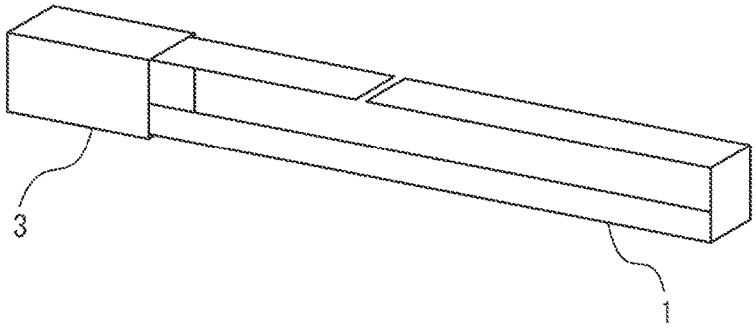
FIG. 6 is a schematic perspective view of the loop antenna which is equipped at one long side end with the frequency characteristic adjusting jig depicted in FIG. 3.

The frequency characteristic adjusting jig 3 may be attached to only one long side end of the loop antenna 1, as illustrated in FIG. 6.

Figure 7:
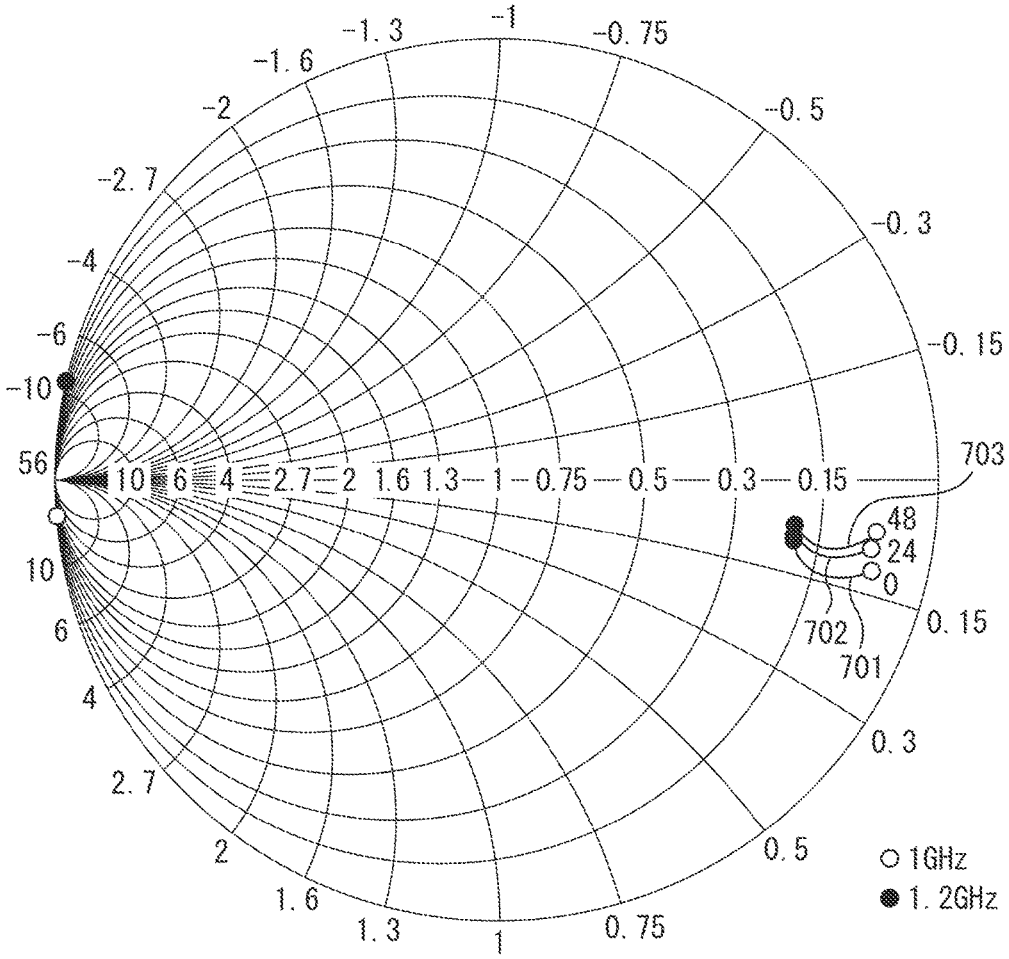
FIG. 7 is a Smith chart illustrating the relationship between the length of the frequency characteristic adjusting jig along the long side of the loop antenna and the parallel inductance component of the loop antenna when the frequency characteristic adjusting jig is attached to only one long side end of the loop antenna.

FIG. 7 is a Smith chart illustrating the relationship between the length L and the parallel inductance component of the loop antenna when the frequency characteristic adjusting jig 3 is attached to only one long side end of the loop antenna 1.

In FIG. 7, curves 701 to 703 describe the parallel inductance component at frequencies of 1 GHz to 1.2 GHz when the length L of the frequency characteristic adjusting jig 3 along the long side of the loop antenna 1 is set to 0 mm, 24 mm, and 48 mm, respectively. As depicted by the curves 701 to 703, the longer the length L, the smaller is the parallel inductance component at frequencies of 1 GHz to 1.2 GHz. However, compared with the case where two frequency characteristic adjusting jigs 3 are attached, the change of the parallel inductance component with respect to the change of the length L is small. Further, in this example, the length of the path of the current that flows from the feed point 2 and passes through the long side end of the loop antenna 1 to which the frequency characteristic adjusting jig 3 is not attached is constant regardless of the length L of the frequency characteristic adjusting jig 3. As a result, the amount of change of the parallel inductance component with respect to the change of the length L is smaller than one half of the amount of change of the parallel inductance component when two frequency characteristic adjusting jigs 3 are attached.

The length L of the frequency characteristic adjusting jig 3 may be set so that the face 3*b* covers the feed point 2 when the frequency characteristic adjusting jig 3 is attached to the loop antenna 1. In this case, conversely to that depicted in FIG. 7, the parallel inductance component of the loop antenna 1 becomes larger as the length L increases. Accordingly, the frequency characteristic of the loop antenna 1 equipped with the frequency characteristic adjusting jig 3 shifts toward lower frequencies as the length L increases.

Figure 8A:
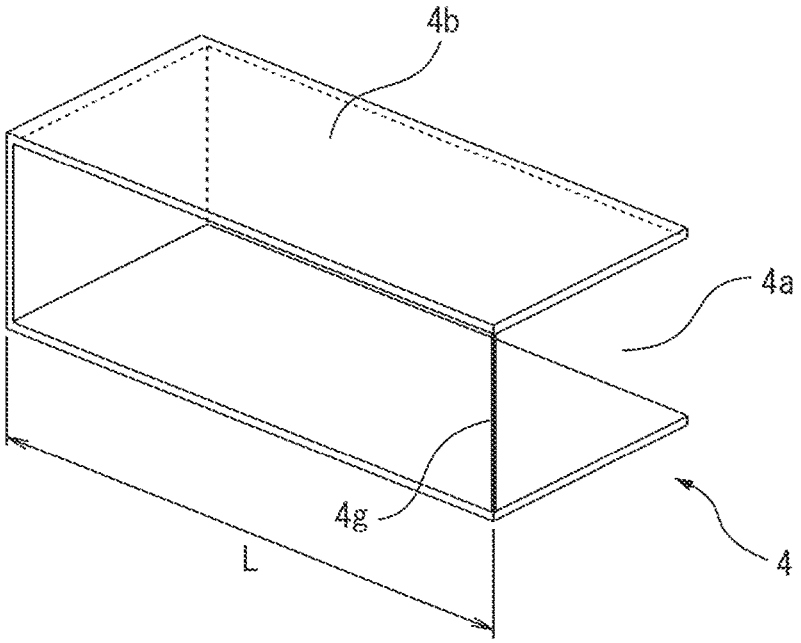
FIG. 8A is a schematic perspective view of a frequency characteristic adjusting jig according to a modified example.
Figure 8B:
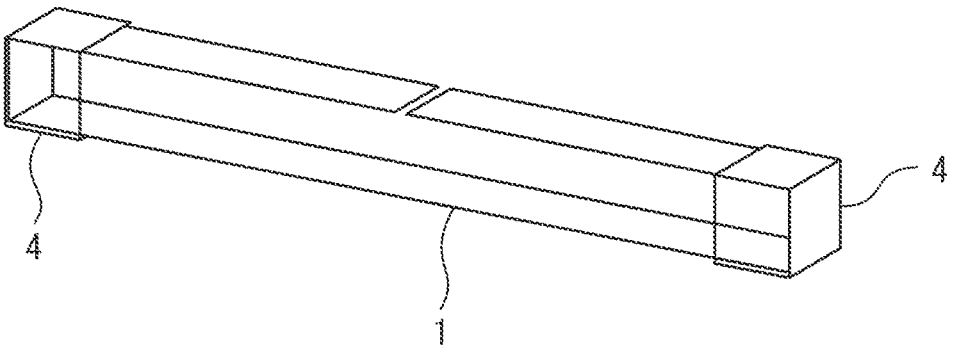
FIG. 8B is a schematic perspective view of the loop antenna when the frequency characteristic adjusting jig depicted in FIG. 8A is attached to each long side end of the loop antenna.

FIG. 8A is a schematic perspective view of a frequency characteristic adjusting jig 4 according to a modified example. FIG. 8B is a schematic perspective view of the loop antenna 1 when the frequency characteristic adjusting jig 4 depicted in FIG. 8A is attached to each long side end of the loop antenna 1. The frequency characteristic adjusting jig 4 according to this modified example includes a conductive wire 4*g*, extending along one side of an open end 4*a*, for connecting the faces 4*b* and 4*c* that face the respective long sides of the loop antenna 1 when the frequency characteristic adjusting jig 4 is attached to the loop antenna 1. The wire 4*g* according to the modified example is another example of the third member and the path of the current flowing through the loop antenna 1 is short-circuited via the wire 4*g*. Accordingly, the longer the length L of the frequency characteristic adjusting jig 4 along the long side of the loop antenna 1, i.e., the longer the distance from one end point of the face 4*b* connected to the wire 4*g* to the opposite end point of the face 4*b* along the long side, the smaller is the parallel inductance of the loop antenna 1.

Figure 9:
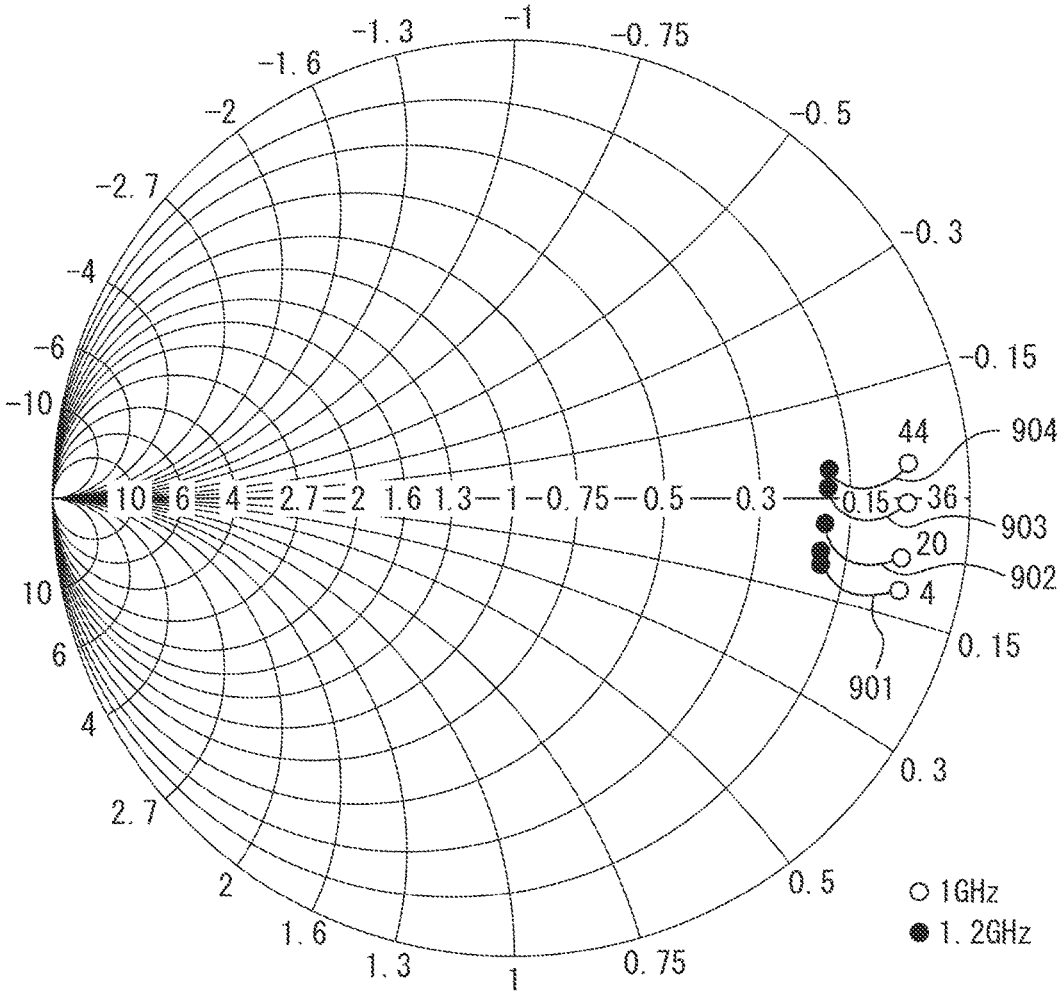
FIG. 9 is a Smith chart illustrating the relationship between the length of the frequency characteristic adjusting jig of FIG. 8A along the long side of the loop antenna and the parallel inductance component of the loop antenna.

FIG. 9 is a Smith chart, obtained by electromagnetic field simulation, that defines the relationship between the length L of the frequency characteristic adjusting jig 4 along the long side of the loop antenna 1 and the parallel inductance component of the loop antenna 1.

In FIG. 9, curves 901 to 904 describe the parallel inductance component at frequencies of 1 GHz to 1.2 GHz when the length L of the frequency characteristic adjusting jig 4 along the long side of the loop antenna is set to 4 mm, 20 mm, 36 mm, and 44 mm, respectively. As depicted by the curves 901 to 904, in this modified example also, the longer the length L, the smaller is the parallel inductance component at frequencies of 1 GHz to 1.2 GHz. Accordingly, the frequency characteristic of the loop antenna 1 equipped with the two frequency characteristic adjusting jigs 4 shifts toward higher frequencies as the length L increases.

According to another modified example, the two frequency characteristic adjusting jigs attached to both long side ends of the loop antenna 1 may be electrically connected together.

Figure 10:
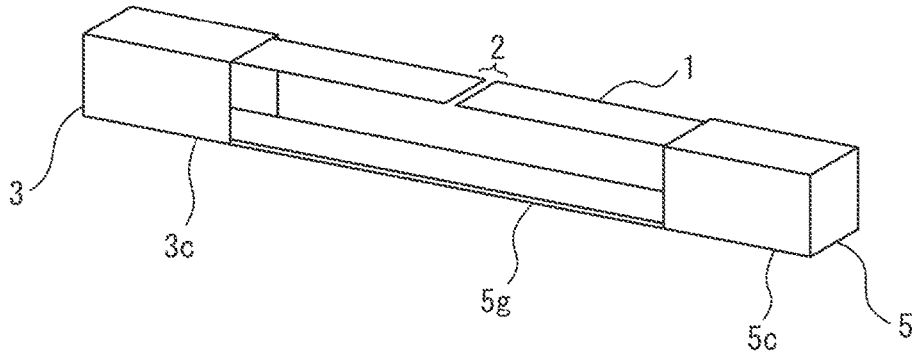
FIG. 10 is a schematic perspective view of the loop antenna when two frequency characteristic adjusting jigs are attached to both long side ends of the antenna in accordance with another modified example.

FIG. 10 is a schematic perspective view illustrating the loop antenna 1 which is equipped at one long side end with the frequency characteristic adjusting jig 3 and at the other long side end with a frequency characteristic adjusting jig 5 according to this modified example. The frequency characteristic adjusting jig 5 according to this modified example differs from the frequency characteristic adjusting jig 3 by the inclusion of a connecting portion 5*g* which electrically connects the two frequency characteristic adjusting jigs 5 when attached to the loop antenna 1.

For example, when the frequency characteristic adjusting jig 5 is attached to the loop antenna 1, the connecting portion 5*g* is routed along the long side opposite the long side provided with the feed point 2. The connecting portion 5*g* is formed, for example, from the same conductor that forms the frequency characteristic adjusting jig 5. The connecting portion 5*g* is formed, for example, by extending the face 5*c* of the frequency characteristic adjusting jig 5 outwardly from the open end thereof. The width of the connecting portion 5*g* measured in a direction crossing the long side of the loop antenna 1 is substantially equal to the width of the face 5*c*. The end of the connecting portion 5*g* is inserted between the loop antenna 1 and the face 3*c* of the frequency characteristic adjusting jig 3 attached to the other long side end of the loop antenna 1. In this way, the connecting portion 5*g* is electrically connected to the face 3*c* of the frequency characteristic adjusting jig 3. As a result, the two frequency characteristic adjusting jigs, when attached to the loop antenna 1, are electrically connected together. The connecting portion 5*g* may be formed in any other suitable shape, provided that it can be electrically connected to the frequency characteristic adjusting jig 3.

Figure 11:
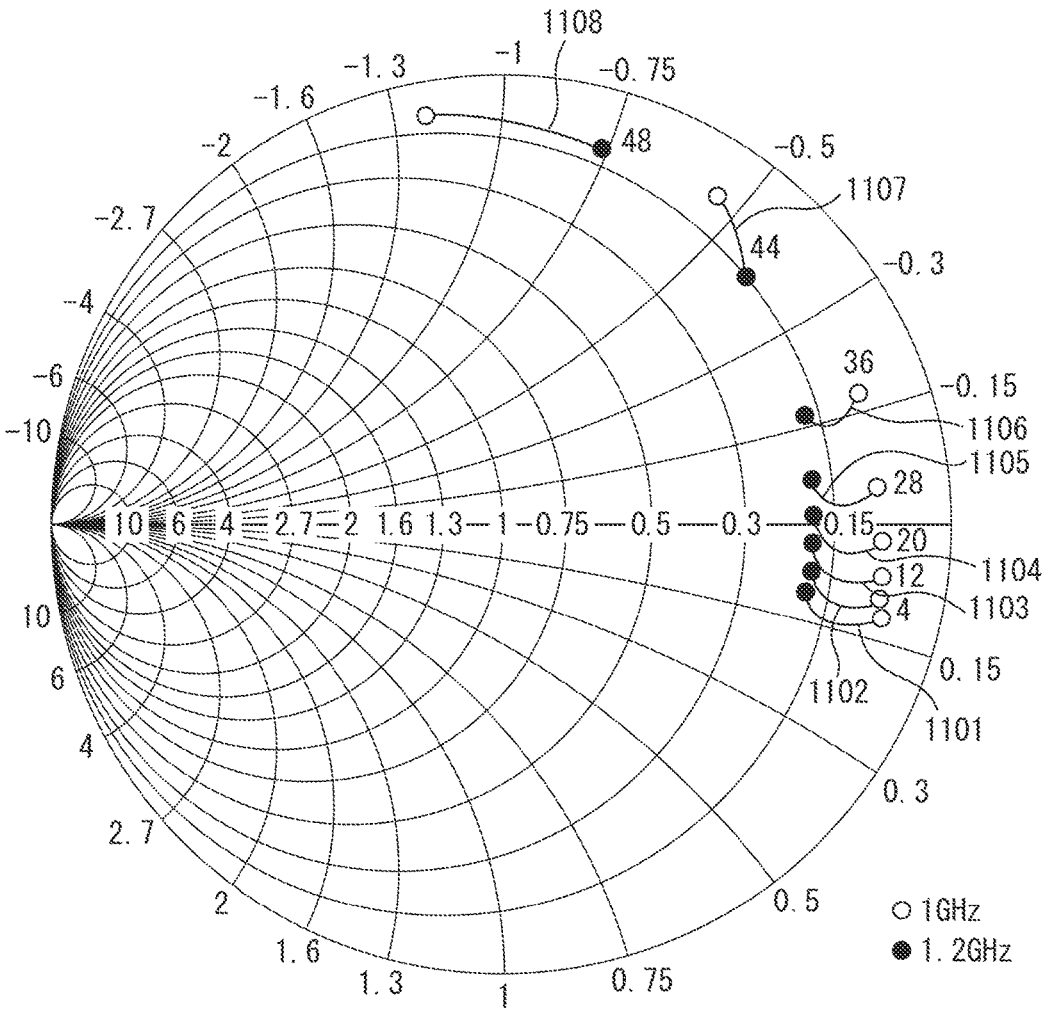
FIG. 11 is a Smith chart illustrating the relationship between the length of the frequency characteristic adjusting jig according to the modified example of FIG. 10 along the long side of the loop antenna and the parallel inductance component of the loop antenna.

FIG. 11 is a Smith chart, obtained by electromagnetic field simulation, that defines the relationship between the length L of the frequency characteristic adjusting jigs 3 and 5 along the long side of the loop antenna 1 and the parallel inductance component of the loop antenna 1.

In FIG. 11, curves 1101 to 1108 describe the parallel inductance component at frequencies of 1 GHz to 1.2 GHz when the length L of the two frequency characteristic adjusting jigs along the long side of the loop antenna 1 is set to 0 mm, 4 mm, 12 mm, 20 mm, 28 mm, 36 mm, 44 mm, and 48 mm, respectively. As depicted by the curves 1101 to 1108, in this modified example, compared with the case where the two frequency characteristic adjusting jigs 3 are not electrically connected together, the parallel inductance component at frequencies of 1 GHz to 1.2 GHz decreases at a greater rate as the length L increases. It can therefore be seen that, when the frequency characteristic adjusting jig 5 is used, the frequency characteristic of the loop antenna 1 can be shifted toward even higher frequencies for the same the length L of the frequency characteristic adjusting jig.

According to still another modified example, the connecting portion for electrically connecting the two frequency characteristic adjusting jigs attached to the loop antenna 1 may be formed not from the plate-like conductor but from a wire-like conductor that extends from one frequency characteristic adjusting jig to the other frequency characteristic adjusting jig. Such a wire-like conductor may be formed along the long side of the loop antenna, or may be formed so as to connect the two faces of the frequency characteristic adjusting jigs along the plane of the loop. Further alternatively, the connecting portion may include a plurality of such wire-like conductors. For example, the connecting portion may include three such wire-like conductors. Of the three conductors, one conductor may be formed along the long side of the loop antenna opposite the long side provided with the feed point 2, and the other two conductors may be formed so as to connect the two faces of the frequency characteristic adjusting jigs along the plane of the loop. In these modified examples also, since the feed point is not covered with the connecting portion, the frequency characteristic of the loop antenna 1 shifts toward higher frequencies as the length L of the frequency characteristic adjusting jigs increases. A connecting portion made of a wire-like conductor about 1 mm in width may be formed so as to pass directly above the feed point 2. When the connecting portion is formed from a wire-like conductor, if the connecting portion is formed along the long side of the loop antenna provided with the feed point 2, the feed point 2 will not be covered with the connecting portion. Therefore, in this case also, the frequency characteristic of the loop antenna 1 shifts toward higher frequencies as the length L of the frequency characteristic adjusting jigs increases.

Figure 12A:
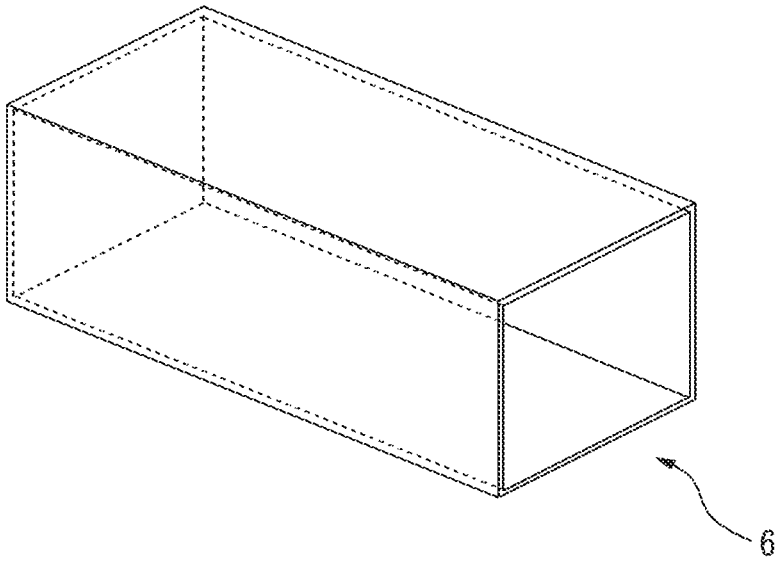
FIG. 12A is a schematic perspective view of a frequency characteristic adjusting jig according to yet another modified example.
Figure 12B:
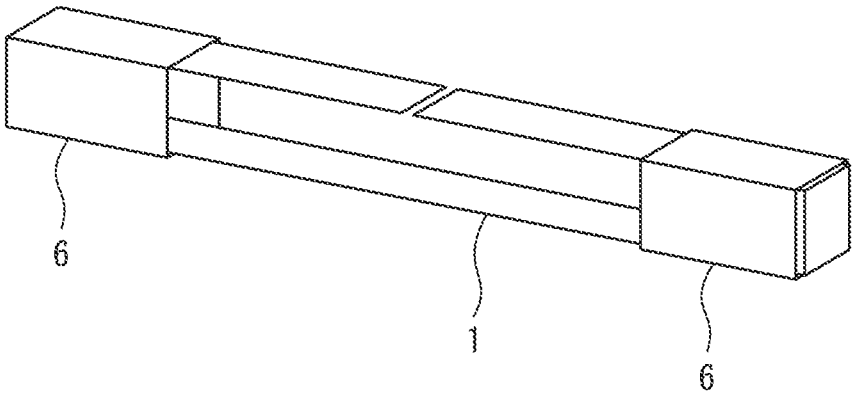
FIG. 12B is a schematic perspective view of the loop antenna when the frequency characteristic adjusting jig depicted in FIG. 12A is attached to each long side end of the loop antenna.

FIG. 12A is a schematic perspective view of a frequency characteristic adjusting jig 6 according to yet another modified example. FIG. 12B is a schematic perspective view of the loop antenna 1 when the frequency characteristic adjusting jig 6 depicted in FIG. 12A is attached to each long side end of the loop antenna 1. The frequency characteristic adjusting jig 6 according to this modified example differs from the frequency characteristic adjusting jig 3 in that the frequency characteristic adjusting jig 6 does not have a face that is positioned to face the short side when the jig is attached to the loop antenna 1. More specifically, the frequency characteristic adjusting jig 6 is formed in the shape of a tube open at both ends, each open end being identical in shape to the short side of the loop antenna 1. In this modified example, the relationship between the length L of the frequency characteristic adjusting jig 6 along the long side of the loop antenna 1 and the parallel inductance component of the loop antenna 1 differs from that of any other embodiment.

Figure 13:
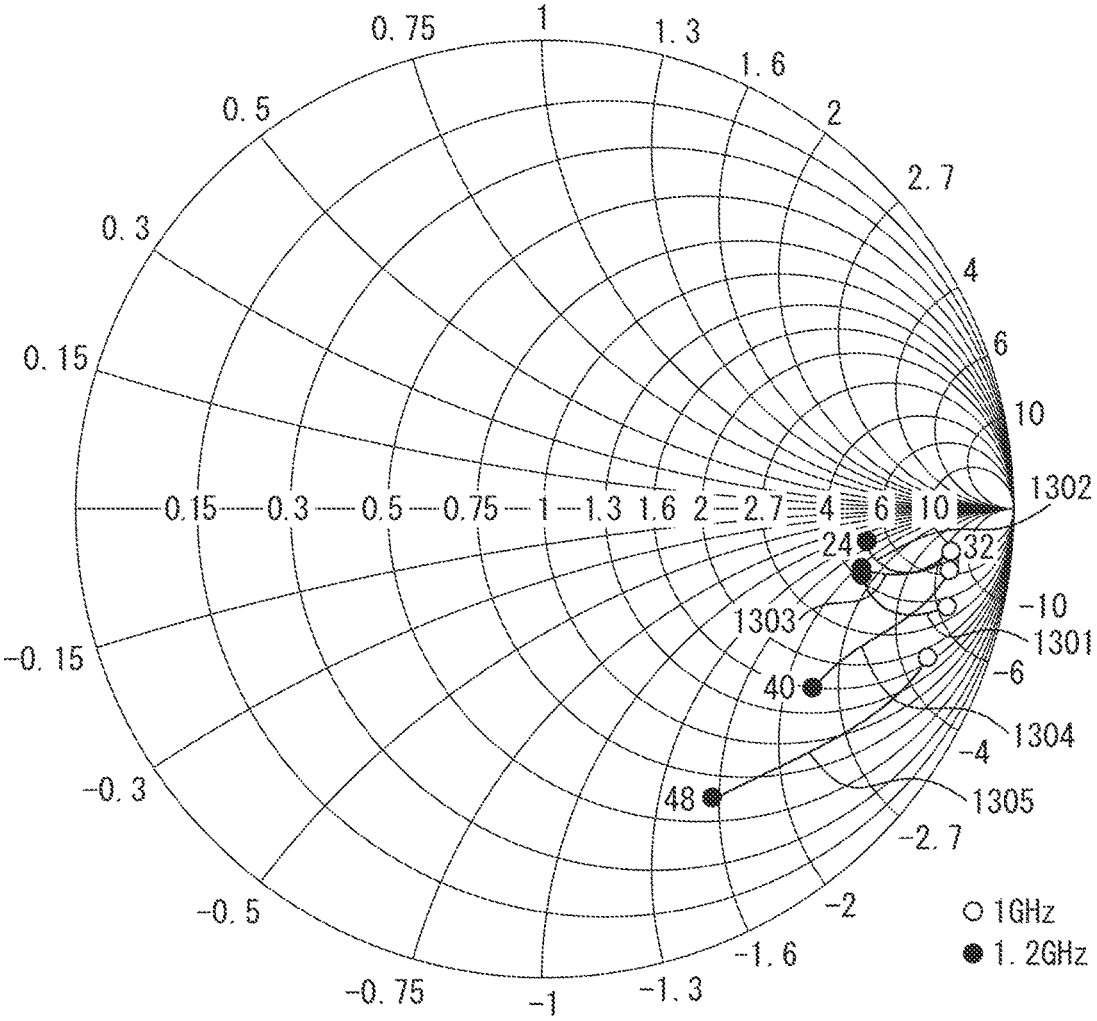
FIG. 13 is a Smith chart illustrating the relationship between the length of the frequency characteristic adjusting jig according to the modified example of FIG. 12A along the long side of the loop antenna and the parallel inductance component of the loop antenna.

FIG. 13 is a Smith chart, obtained by electromagnetic field simulation, that defines the relationship between the length L of the frequency characteristic adjusting jig 6 along the long side of the loop antenna 1 and the parallel inductance component of the loop antenna 1.

In FIG. 13, curves 1301 to 1305 describe the parallel inductance component at frequencies of 1 GHz to 1.2 GHz when the length L of the frequency characteristic adjusting jig 6 along the long side of the loop antenna 1 is set to 0 mm, 24 mm, 32 mm, 40 mm, and 48 mm, respectively. Further, in this example, the two frequency characteristic adjusting jigs 6 are attached to the loop antenna 1 in such a manner that the farther end of each frequency characteristic adjusting jig 6 as viewed from the feed point 2 is positioned at the same position as the corresponding short side of the loop antenna.

As depicted by the curves 1301 and 1302, when the length L is in the range of 0 mm to 24 mm, the parallel inductance component at frequencies of 1 GHz to 1.2 GHz becomes smaller as the length L increases. On the other hand, as depicted by the curves 1302 to 1305, when the length L exceeds 24 mm, the parallel inductance component becomes larger as the length L increases. Accordingly, when the length L is longer than 24 mm, the frequency characteristic of the loop antenna 1 equipped with the two frequency characteristic adjusting jigs 6 shifts toward lower frequencies as the length L increases.

In this modified example, the longer the length L, the stronger is the current that flows through the end portion located farther from the feed point 2 of the frequency characteristic adjusting jig 6, and the weaker is the current that flows through the end portion located nearer to the feed point 2 of the frequency characteristic adjusting jig 6. On the other hand, in the case of the frequency characteristic adjusting jig 3, the current that flows through the end portion located farther from the feed point 2 of the frequency characteristic adjusting jig 3 does not become stronger, because the end is closed with the face 3*f*. As a result, even when the frequency characteristic adjusting jig 6 is attached to the loop antenna 1, the path of the current that flows through the loop antenna 1 does not become short. Furthermore, in this case, when the frequency characteristic adjusting jig 6 is attached to the loop antenna 1, a capacitor is formed which is connected in parallel with the resistor Ra and coil La in the equivalent circuit of the loop antenna 1. Accordingly, as the length L increases, the capacitance of the capacitor increases, and as a result, the parallel inductance component becomes larger.

When the two faces of the frequency characteristic adjusting jig 6 that face the two long sides of the loop antenna 1 are in direct contact with the respective long sides, no capacitor is formed between the loop antenna 1 and the frequency characteristic adjusting jig 6. Further, the path of the current that flows through the loop antenna 1 is short-circuited by the frequency characteristic adjusting jig 6. As a result, the parallel inductance component becomes smaller as the length L increases, as in the case of the loop antenna 1 equipped with the frequency characteristic adjusting jig 3.

Further, the two frequency characteristic adjusting jigs 6 attached to the loop antenna 1 may be electrically connected together by a conductive connecting member provided along the long side of the loop antenna 1, just like the two frequency characteristic adjusting jigs depicted in FIG. 10. In this case, conversely to that depicted in FIG. 13, the parallel inductance component becomes smaller as the length L increases, because the path of the current that flows through the loop antenna 1 is short-circuited by the connecting member.

Figure 14:
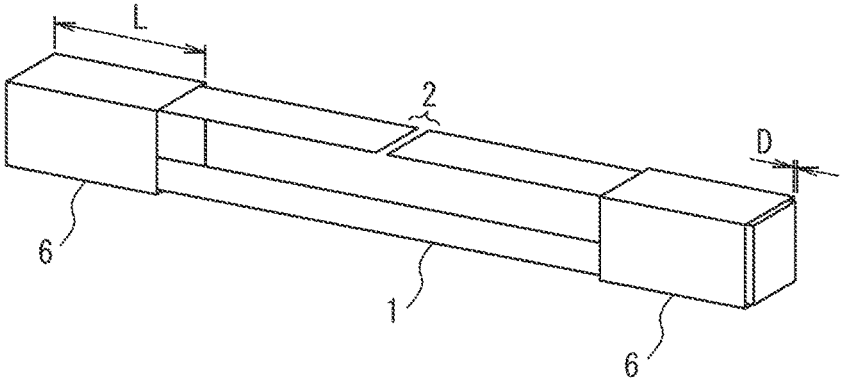
FIG. 14 is a schematic perspective view of the loop antenna when two frequency characteristic adjusting jigs, each according to the modified example of FIG. 12A, are attached halfway along the long side of the loop antenna.

Furthermore, in this modified example, the parallel inductance component of the loop antenna 1 also varies depending on the position at which the frequency characteristic adjusting jig 6 is attached. For example, the parallel inductance component of the loop antenna 1 varies when the distance D in FIG. 14 between the farther end of each frequency characteristic adjusting jig 6 as viewed from the feed point 2 and the corresponding short side of the loop antenna 1 is varied.

Figure 15:
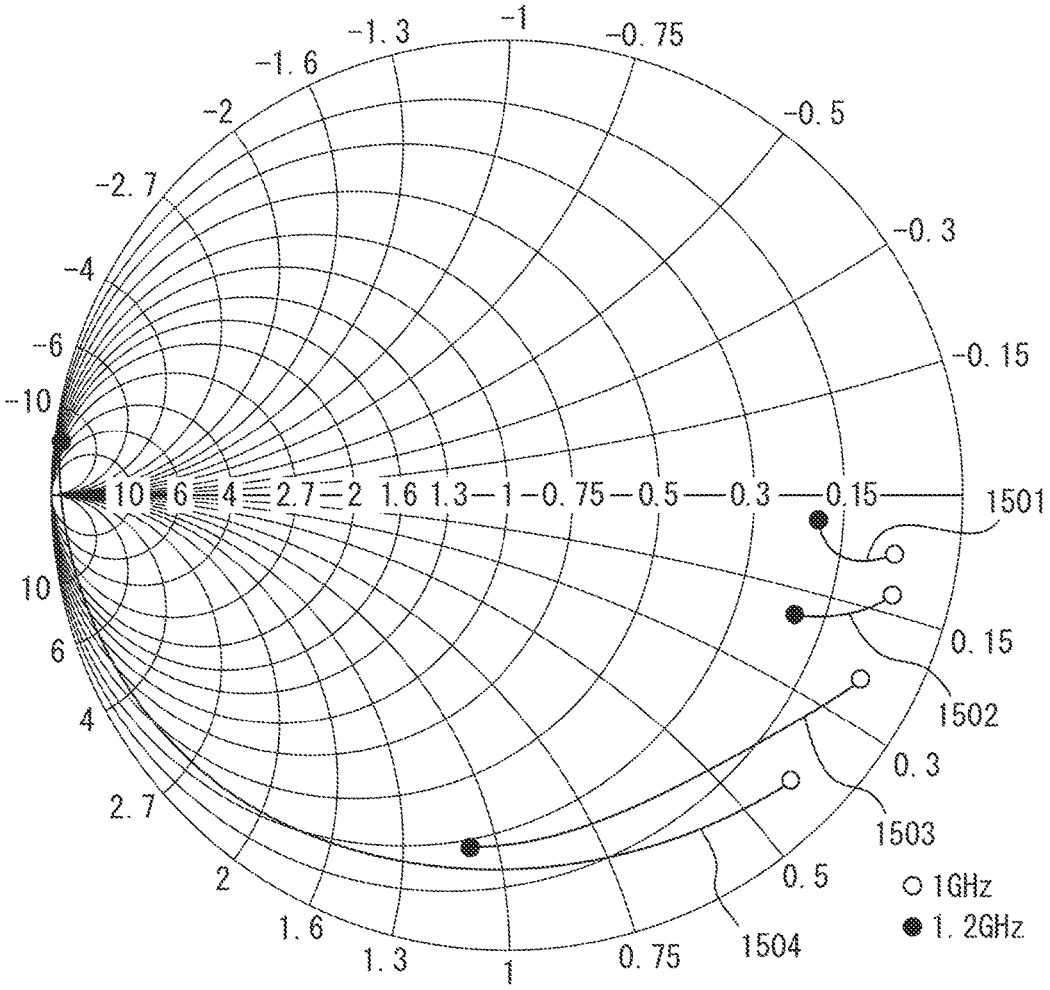
FIG. 15 is a Smith chart illustrating the relationship between the position of the two frequency characteristic adjusting jigs, each according to the modified example of FIG. 12A, attached to the loop antenna and the parallel inductance component of the loop antenna.

FIG. 15 is a Smith chart, obtained by electromagnetic field simulation, that defines the relationship between the position of the two frequency characteristic adjusting jigs 6 attached to the loop antenna and the parallel inductance component of the loop antenna 1. It is assumed that the length L of the frequency characteristic adjusting jig 6 along the long side of the loop antenna 1 is 20 mm.

In FIG. 15, curves 1501 to 1504 describe the parallel inductance component at frequencies of 1 GHz to 1.2 GHz when the distance D between the farther end of each frequency characteristic adjusting jig 6 as viewed from the feed point 2 and the corresponding short side of the loop antenna 1 is set to 0 mm, 4 mm, 8 mm, and 12 mm, respectively. As depicted by the curves 1501 to 1504, the parallel inductance component of the loop antenna 1 becomes larger as the distance D increases. Accordingly, the frequency characteristic of the loop antenna 1 equipped with the two frequency characteristic adjusting jigs 6 shifts toward lower frequencies as the distance D increases.

Figure 16:
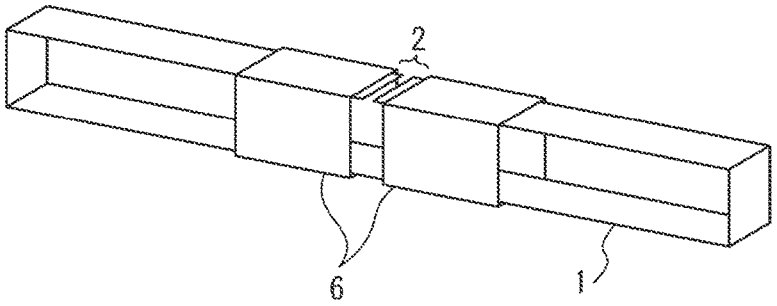
FIG. 16 is a schematic perspective view of the loop antenna when two frequency characteristic adjusting jigs, each according to the modified example of FIG. 12A, are attached halfway along the long side of the loop antenna.

As illustrated in FIG. 16, in this modified example, the two frequency characteristic adjusting jigs 6 may be attached to the loop antenna 1 in such a manner that the distance between the feed point 2 and the end nearer to the feed point 2 is the same for both.

Figure 17:
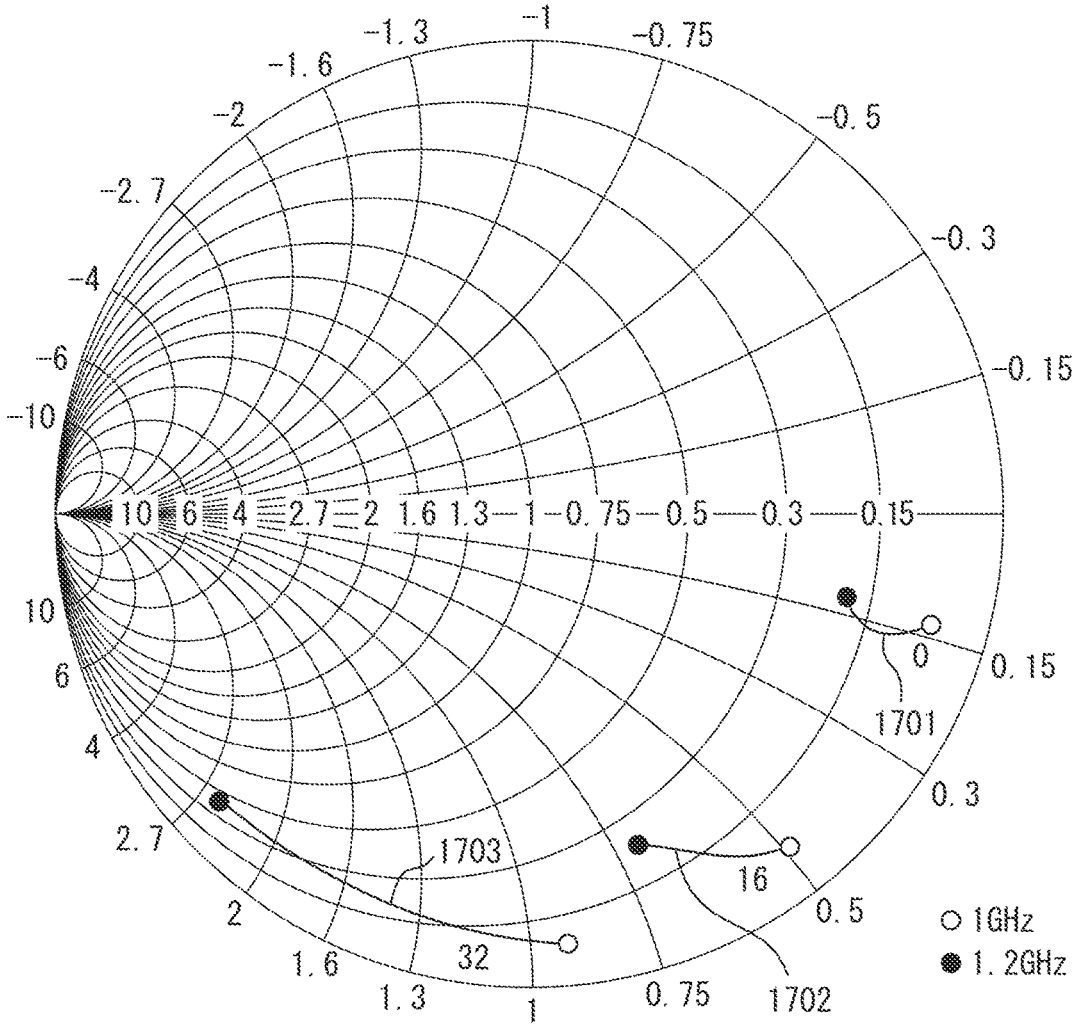
FIG. 17 is a Smith chart illustrating the relationship between the length of the frequency characteristic adjusting jig along the long side of the loop antenna and the parallel inductance component of the loop antenna when the two frequency characteristic adjusting jigs are attached to the loop antenna in the manner depicted in FIG. 16.

FIG. 17 is a Smith chart illustrating the relationship between the length L of the frequency characteristic adjusting jig 6 along the long side of the loop antenna 1 and the parallel inductance component of the loop antenna 1 when the two frequency characteristic adjusting jigs 6 are attached to the loop antenna 1 in the manner depicted in FIG. 16. The two frequency characteristic adjusting jigs 6 are attached so that the spacing between the two frequency characteristic adjusting jigs 6 is 4 mm with the feed point 2 located at the midpoint of the spacing.

In FIG. 17, curves 1701 to 1703 describe the parallel inductance component at frequencies of 1 GHz to 1.2 GHz when the length L is set to 0 mm, 16 mm, and 32 mm, respectively. As depicted by the curves 1701 to 1703, in this example also, the parallel inductance component of the loop antenna 1 becomes larger as the length L increases.

Alternatively, the frequency characteristic adjusting jig 5 including the connecting portion depicted in FIG. 10 and the frequency characteristic adjusting jig 6 depicted in FIG. 12A may be attached to the loop antenna 1, and the frequency characteristic adjusting jig 5 and the frequency characteristic adjusting jig 6 may be electrically connected together.

Figure 18:
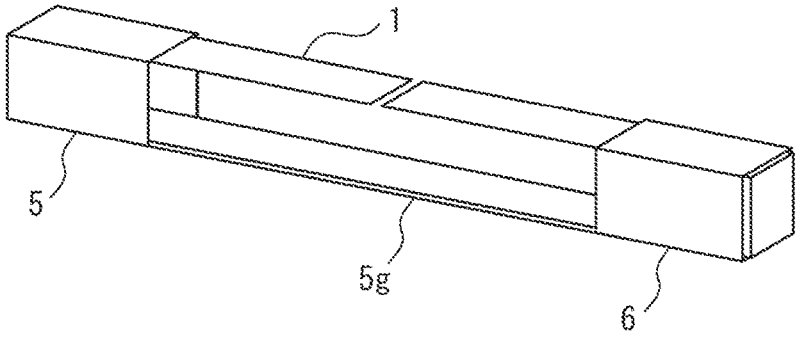
FIG. 18 is a schematic perspective view of the loop antenna to which the frequency characteristic adjusting jig of FIG. 10 and the frequency characteristic adjusting jig of FIG. 12A have been attached.

FIG. 18 is a schematic perspective view of the loop antenna 1 to which the frequency characteristic adjusting jig 5 and the frequency characteristic adjusting jig 6 have been attached. In this modified example, the end of the connecting portion 5*g* extending from the frequency characteristic adjusting jig 5 along the long side of the loop antenna 1 opposite the long side provided with the feed point 2 is inserted between the loop antenna 1 and the frequency characteristic adjusting jig 6. In this way, the frequency characteristic adjusting jig 5 is electrically connected to the frequency characteristic adjusting jig 6. In this modified example, the loop antenna can be inserted from the end of the frequency characteristic adjusting jig 6 opposite from the frequency characteristic adjusting jig 5 into the frequency characteristic adjusting jig 6 and then into the frequency characteristic adjusting jig 5. As a result, even when one of the two frequency characteristic adjusting jigs has a face that faces the short side of the loop antenna 1, the two frequency characteristic adjusting jigs can be easily attached to the loop antenna 1.

Figure 19:
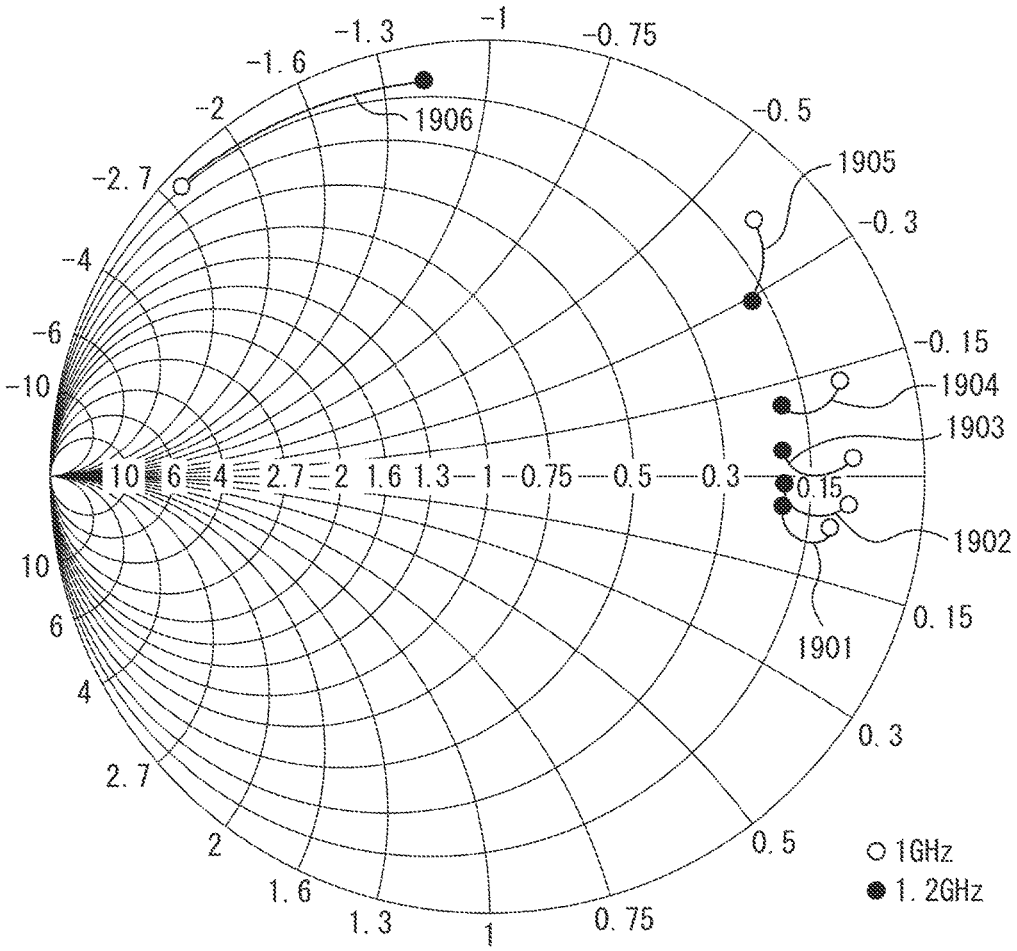
FIG. 19 is a Smith chart illustrating the relationship between the length of each frequency characteristic adjusting jig along the long side of the loop antenna and the parallel inductance component of the loop antenna when the two frequency characteristic adjusting jigs are attached to the loop antenna as depicted in FIG. 18.

FIG. 19 is a Smith chart illustrating the relationship between the length L of each frequency characteristic adjusting jig along the long side of the loop antenna 1 and the parallel inductance component of the loop antenna 1 when the frequency characteristic adjusting jigs 5 and 6 are attached to the loop antenna 1.

In FIG. 19, curves 1901 to 1906 describe the parallel inductance component at frequencies of 1 GHz to 1.2 GHz when the length L of the frequency characteristic adjusting jig 6 is set to 8 mm, 16 mm, 24 mm, 32 mm, 40 mm, and 48 mm, respectively. The length of the frequency characteristic adjusting jig 5 along the long side of the loop antenna 1 is set equal to the length L of the frequency characteristic adjusting jig 6 plus 1 mm. As depicted by the curves 1901 to 1906, in this example, the parallel inductance component of the loop antenna 1 becomes smaller as the length L increases. In other words, the frequency characteristic of the loop antenna 1 equipped with the two frequency characteristic adjusting jigs shifts toward higher frequencies as the length L increases.

In the various frequency characteristic adjusting jigs so far described, each face may be formed with a plurality slits extending in a direction parallel or perpendicular to the loop.

Next, antenna testing apparatus using the various frequency characteristic adjusting jigs so far described will be described. The antenna testing apparatus is used for testing the loop antenna to determine whether the performance of the loop antenna satisfies the pass/fail criteria by using a frequency different from the operating frequency of the loop antenna, for example, because of restrictions imposed by standards or law regulations.

The example described hereinafter assumes that the loop antenna to be tested is a loop antenna having a three-dimensional shape such as illustrated in FIG. 1 and is built into an RFID tag including a signal processing circuit for communication.

Figure 20:
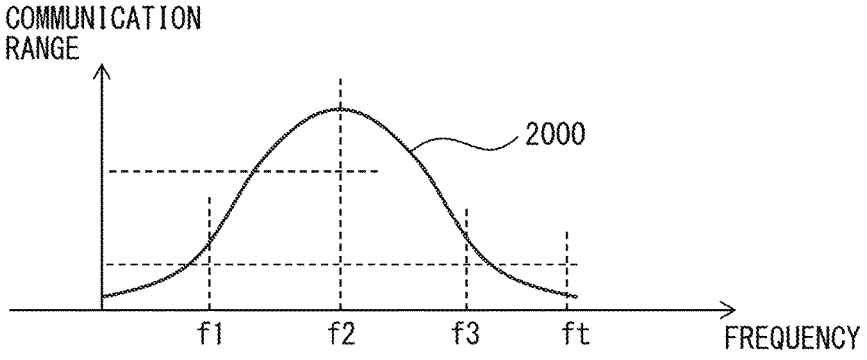
FIG. 20 is a diagram illustrating one example of the frequency characteristic of an RFID tag incorporating the loop antenna to be tested.

FIG. 20 is a diagram illustrating one example of the frequency characteristic of the RFID tag incorporating the loop antenna to be tested. In FIG. 20, the abscissa represents the frequency of the radio wave transmitted or received by the RFID tag. The ordinate represents the maximum range over which the RFID tag can communicate with a reader/writer (hereinafter simply referred to as the communication range). Graph 2000 depicts the relationship between the frequency and the communication range of the loop antenna to be tested. In the illustrated example, the RFID tag incorporating the loop antenna to be tested is designed to operate in the frequency range of f1 to f3. As depicted by the graph 2000, the communication range of the RFID tag is maximum at frequency f2 which is the midpoint between the frequencies f1 and f3. On the other hand, the frequency ft that can be used for testing the loop antenna is assumed to be higher than the frequency f3. In this case, if the communication range of the loop antenna at the frequency ft is directly measured, the communication range of the loop antenna in the frequency range of f1 to f3 may not be found accurately, because in the vicinity of the frequency ft, the communication range of the loop antenna only changes mildly with frequency.

In view of the above, the frequency characteristic of the loop antenna is shifted toward the frequency ft by attaching the frequency characteristic adjusting jig according to any one of the above embodiments or modified examples to the RFID tag incorporating the loop antenna.

Figure 21:
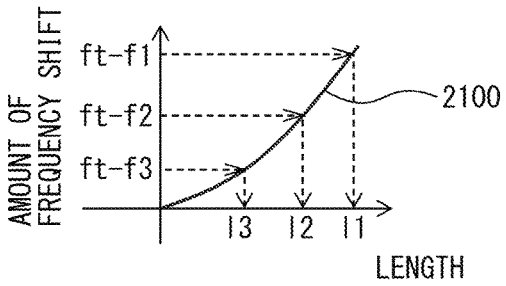
FIG. 21 is a conceptual diagram illustrating the relationship between the length, along the long side of the loop antenna, of the frequency characteristic adjusting jig attached to the RFID tag and the amount by which the frequency characteristic of the loop antenna incorporated in the RFID tag is shifted.

FIG. 21 is a conceptual diagram illustrating the relationship between the length L, along the long side of the loop antenna, of the frequency characteristic adjusting jig attached to the RFID tag and the amount by which the frequency characteristic of the loop antenna incorporated in the RFID tag is shifted. In FIG. 21, the length L of the frequency characteristic adjusting jig is plotted along the abscissa and the amount of frequency shift along the ordinate. Graph 2100 depicts the relationship between the length L and the amount of frequency shift.

For example, when the frequency characteristic adjusting jig 3 depicted in FIG. 3 is attached to the RFID tag, the frequency characteristic of the loop antenna to which the frequency characteristic adjusting jig 3 is attached shifts toward higher frequencies as the length L of the frequency characteristic adjusting jig 3 increases, as previously described. Then, the length 11 of the frequency characteristic adjusting jig 3 corresponding to the amount of shift from the frequency f3 to the frequency ft is obtained by electromagnetic field simulation or by using a non-defective RFID tag that satisfies prescribed criteria (for example, pre-shipment inspection criteria). Similarly, the lengths 12 and 13 of the frequency characteristic adjusting jig 3 corresponding to the amount of shift from the frequency f2 to the frequency ft and the amount of shift from the frequency f1 to the frequency ft, respectively, are obtained. On the other hand, if the frequency ft to be used for the testing is lower than the operating frequency range of f1 to f3 of the loop antenna, the frequency characteristic adjusting jig 6 depicted in FIG. 12A, for example, may be attached to the RFID tag incorporating the loop antenna.

Then, the RFID tag communication range as one example of a metric for measuring the performance of the loop antenna is measured in advance for a radio wave of frequency ft when frequency characteristic adjusting jigs having lengths 11, 12, and 13, respectively, are each attached to the non-defective RFID tag. Then, based on the measured value, the threshold value of the communication range is obtained as the pass/fail criteria value.

A metric other than the communication range may be used as the loop antenna communication performance metric used for testing the loop antenna. For example, the minimum value P(f) of the power of the radio wave radiated from the reader/writer, with which the RFID tag and the reader/writer can communicate with each other when the RFID tag incorporating the loop antenna is located at a predetermined distance from the reader/writer, may be used as the loop antenna communication performance metric. In this case, in FIG. 20, for example, the minimum value P(f2) of the power is the smallest at the frequency f2, and the minimum value P(f) of the power increases as the frequency of the radio wave decreases below or increases above the frequency f2.

By attaching the frequency characteristic adjusting jig to the RFID tag incorporating the loop antenna, the frequency characteristic of the loop antenna can be shifted as described above. Therefore, the antenna testing apparatus determines whether the loop antenna is defective or non-defective by evaluating the value of the communication performance metric at the frequency ft of the loop antenna of the RFID tag to which the frequency characteristic adjusting jig is attached.

Figure 22:
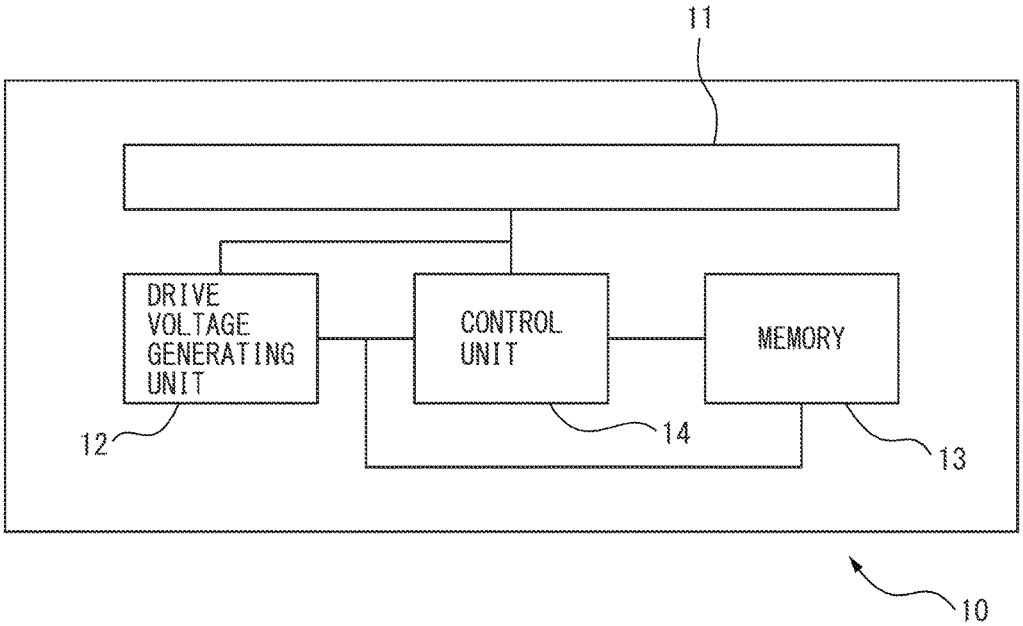
FIG. 22 is a diagram schematically illustrating the configuration of the RFID tag incorporating the loop antenna to be tested.

FIG. 22 is a diagram schematically illustrating the configuration of the RFID tag incorporating the loop antenna to be tested. In the illustrated example, the RFID tag 10 is a passive RFID tag, and includes a loop antenna 11, a drive voltage generating unit 12, a memory 13, and a control unit 14.

The loop antenna 11 is the loop antenna to be tested, and has a three-dimensional shape such as illustrated, for example, in FIG. 1. Then, the loop antenna 11 receives a radio wave that the reader/writer in the antenna testing apparatus radiated by superimposing thereon a query signal containing a preamble, converts the received radio wave into an electrical signal, and passes the electrical signal to the drive voltage generating unit 12 and control unit 14 connected to the feed point.

By using, for example, the preamble detected from the electrical signal received from the loop antenna 11, the drive voltage generating unit 12 generates from the electrical signal a voltage for driving the memory 13 and the control unit 14, and supplies the voltage to the memory 13 and the control unit 14. One of various elements used in the RFID tag to convert an electrical signal to a voltage can be used as the drive voltage generating unit 12.

The memory 13 includes a nonvolatile semiconductor memory circuit. The memory 13 stores an ID code for distinguishing the RFID tag 10 from other RFID tags.

The control unit 14 demodulates the electrical signal received from the loop antenna 11 and recovers the query signal carried on the electrical signal. Then, the control unit 14 generates a response signal to the query signal. In this case, the control unit 14 retrieves the ID code from the memory 13 and embeds the ID code into the response signal. The control unit 14 then superimposes the response signal on an electrical signal having a frequency to be radiated from the loop antenna 11. The control unit 14 outputs the electrical signal to the loop antenna 11 and causes the loop antenna 11 to radiate the electrical signal in the form of a radio wave.

If the power of the radio wave that the RFID tag 10 received via the loop antenna 11 is weak, the power for driving the memory 13 and the control unit 14 may not be obtained, and the RFID tag 10 may not be able to radiate the radio wave carrying the response signal. Therefore, by examining the maximum value of the distance between the reader/writer and the RFID tag 10 when the response signal was obtained from the RFID tag 10, the antenna testing apparatus can measure the communication range of the RFID tag 10 as the metric indicating the loop antenna performance. Alternatively, while holding the distance between the RFID tag 10 and the reader/writer fixed, the antenna testing apparatus gradually varies the power of the radio wave being radiated from the reader/writer. Then, the antenna testing apparatus may measure the metric indicating the loop antenna performance by taking the minimum value of the power of the radio wave radiated from the reader/writer when the response signal was obtained from the RFID tag 10. In the example hereinafter described, the antenna testing apparatus uses as the metric indicating the loop antenna performance the minimum value of the power of the radio wave radiated from the reader/writer when the response signal was obtained from the RFID tag 10.

Figure 23:
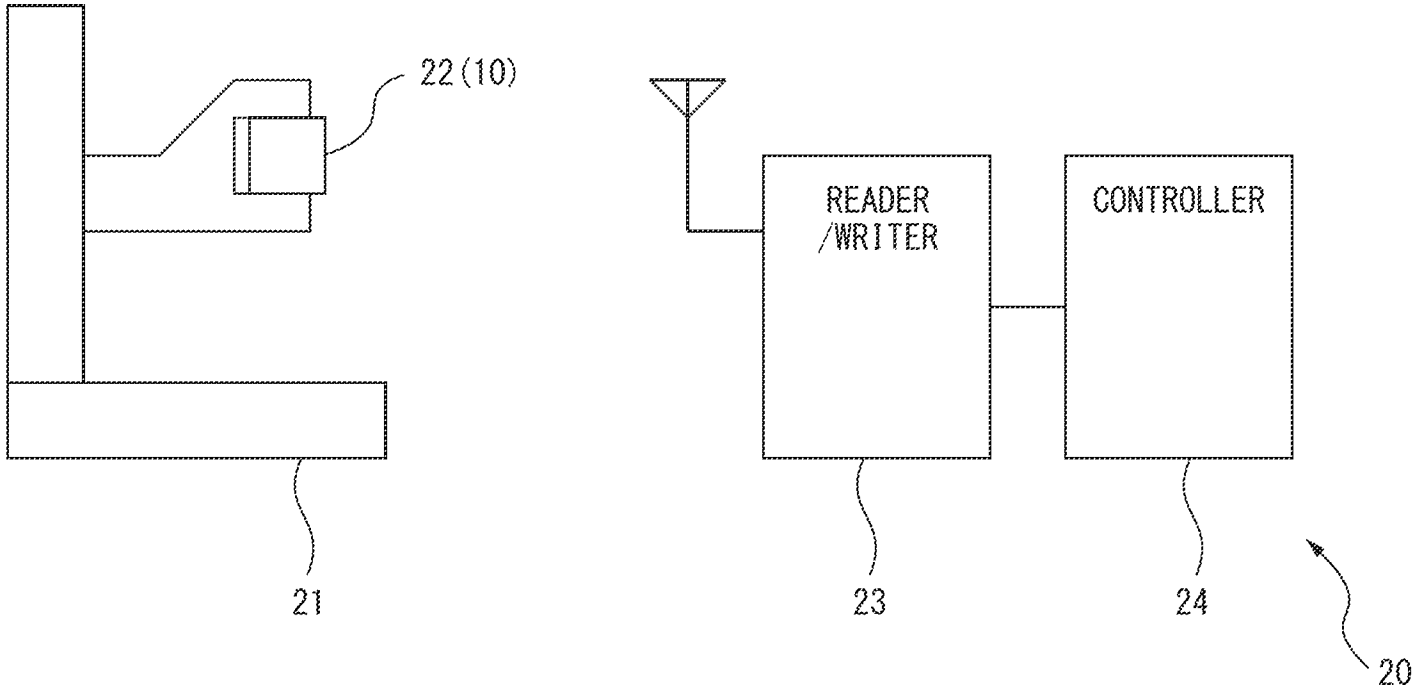
FIG. 23 is a diagram schematically illustrating the configuration of an antenna testing apparatus.

FIG. 23 is a diagram schematically illustrating the configuration of the antenna testing apparatus. The antenna testing apparatus 20 includes a tag holding unit 21, at least one frequency characteristic adjusting jig 22, a reader/writer 23, and a controller 24.

The tag holder 21 holds the RFID tag incorporating the loop antenna under test at a position a predetermined distance (for example, 30 cm to 50 cm) away from the reader/writer 23. For this purpose, the tag holder 21 includes, for example, at least one arm, formed from a dielectric, for holding the RFID tag thereon, and a supporting base for supporting the arm. For example, suppose that the antenna testing apparatus 20 is provided with three kinds of frequency characteristic adjusting jigs 22 having lengths L1, L2, and L3, respectively, measured along the long side of the loop antenna. In this case, the frequency characteristic adjusting jigs 22 are arranged at positions equally spaced from the reader/writer 23, and are each supported on a separate arm. Then, the RFID tag 10 is inserted in a selected one of the frequency characteristic adjusting jigs 22 supported on the respective arms, and is held in position together with the selected frequency characteristic adjusting jig 22. When two frequency characteristic adjusting jigs 22 are used, for example, as illustrated in FIG. 4, the tag holder 21 holds the two frequency characteristic adjusting jigs 22 so that the two frequency characteristic adjusting jigs 22 can be attached to the RFID tag 10. For example, the two frequency characteristic adjusting jigs are arranged in a row with their open ends opposing each other. Then, one of the two frequency characteristic adjusting jigs is mounted on a movable arm so that it can be moved relative to the other frequency characteristic adjusting jig 22 in a direction parallel to the direction in which they are arranged. For example, the RFID tag 10 is first inserted into the frequency characteristic adjusting jig 22 supported on a fixed arm. After that, the frequency characteristic adjusting jig 22 mounted on the movable arm is moved toward the RFID tag 10, and thus the frequency characteristic adjusting jig 22 mounted on the movable arm is also attached to the RFID tag 10. The RFID tag 10 is held on the tag holder 21, for example, in such a manner that the long side provided with the feed point of the loop antenna faces the reader/writer 23.

The at least one frequency characteristic adjusting jig 22 is the frequency characteristic adjusting jig according to any one of the above embodiments or modified examples. As previously described, when the frequency ft used for the testing is higher than the operating frequency range of f1 to f3 of the loop antenna, the frequency characteristic adjusting jig 3 depicted in FIG. 3 or the frequency characteristic adjusting jig 4 depicted in FIG. 8A, for example, is used as the frequency characteristic adjusting jig 22. On the other hand, when the frequency ft used for the testing is lower than the operating frequency range of f1 to f3 of the loop antenna, the frequency characteristic adjusting jig 6 depicted in FIG. 12A, for example, is used as the frequency characteristic adjusting jig 22. Each frequency characteristic adjusting jig 22 is mounted on an arm of the tag holder 21, for example, as described above.

Figure 24:
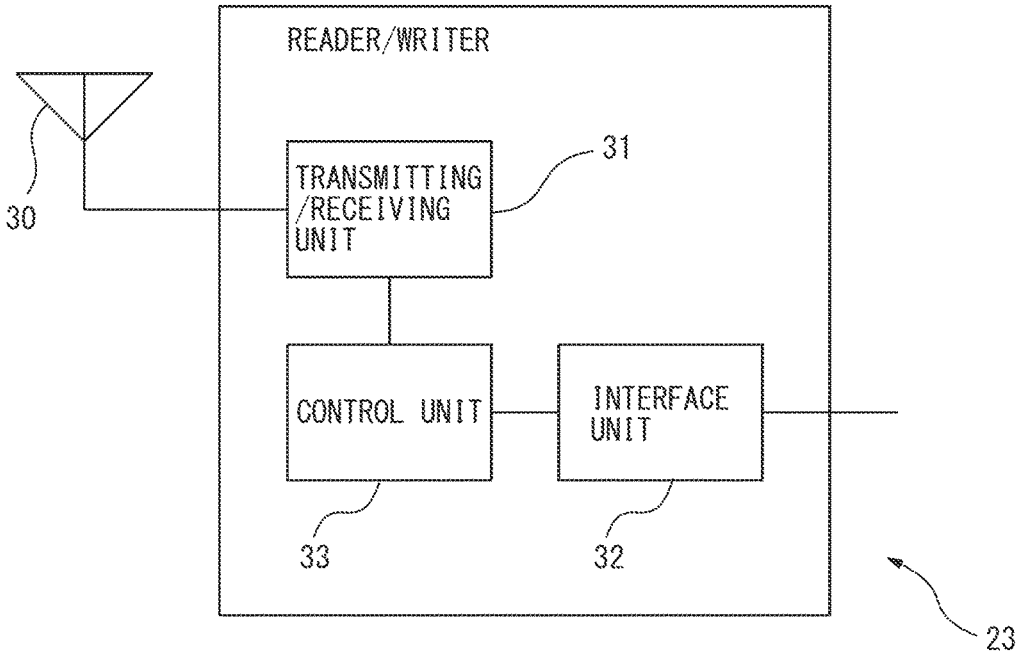
FIG. 24 is a diagram schematically illustrating the configuration of a reader/writer.

FIG. 24 is a diagram schematically illustrating the configuration of the reader/writer 23. The reader/writer 23 is one example of a measuring unit, and includes an antenna 30, a transmitting/receiving unit 31, an interface unit 32, and a control unit 33.

Any one of various antennas capable of transmitting and receiving radio waves to and from the loop antenna 11 of the RFID tag 10 can be used as the antenna 30. When a radio wave of frequency ft on which a query signal is superimposed is received from the transmitting/receiving unit 31, the antenna 30 radiates the radio wave into space. On the other hand, when a radio wave on which a response signal is superimposed is received from the RFID tag 10, the antenna 30 converts the radio wave into an electrical signal and passes the electrical signal to the transmitting/receiving unit 31.

The transmitting/receiving unit 31 causes the antenna 30 to radiate the radio wave for transmission to the RFID tag 10 held on the tag holder 21. When the radio wave carrying the response signal is received from the RFID tag 10 via the antenna 30, the transmitting/receiving unit 31 demodulates the response signal. For this purpose, the transmitting/receiving unit 31 includes a modulator, a demodulator, and an amplifier.

The transmitting/receiving unit 31, using the modulator, modulates the query signal received from the control unit 33 and superimposes it on an electrical signal which is a carrier wave of frequency ft. Then, the transmitting/receiving unit 31 amplifies the electrical signal by the amplifier to increase the transmit power of the electrical signal up to the power value specified by the control unit 33, and outputs the amplified electrical signal to the antenna 30 which then radiates the electrical signal in the form of a radio wave. On the other hand, when the radio wave on which the response signal is superimposed is received from the RFID tag 10 via the antenna 30, the transmitting/receiving unit 31 using the demodulator demodulates the response signal superimposed thereon and passes the response signal to the control unit 33.

The interface unit 32 is a communication interface for the reader/writer 23 to communicate with the controller 24, and may be, for example, an interface conforming to Universal Serial Bus (USB). When a control command such as a query signal transmit command is received from the controller 24, the interface unit 32 passes the command to the control unit 33. When a measurement result signal indicating whether the response signal has been received successfully from the RFID tag 10 is received from the control unit 33, the interface unit 32 outputs the measurement result signal to the controller 24.

The control unit 33 includes at least one processor, a memory, and their peripheral circuitry. The control unit 33 controls each unit of the reader/writer 23. When the query signal transmit command is received from the controller 24, the control unit 33 creates the query signal and passes the query signal to the transmitting/receiving unit 31. Further, the control unit 33 controls the transmitting/receiving unit 31 in accordance with the transmit power value contained in the transmit command so that the transmit power of the radio wave on which the query signal is superimposed is increased up to the power value specified by the transmit command.

Then, the control unit 33 waits for a response signal to be returned from the RFID tag 10 for a predefined time interval (for example, one second) after transmitting the query signal. If the response signal has been received successfully within the predefined time interval, the control unit 33 creates a measurement result signal indicating that the response signal has been received successfully, and outputs the measurement result signal to the controller 24 via the interface unit 32. On the other hand, if the control unit 33 failed to receive the response signal within the predefined time interval, the control unit 33 creates a measurement result signal indicating that the response signal has not been received, and outputs the measurement result signal to the controller 24 via the interface unit 32.

Figure 25:
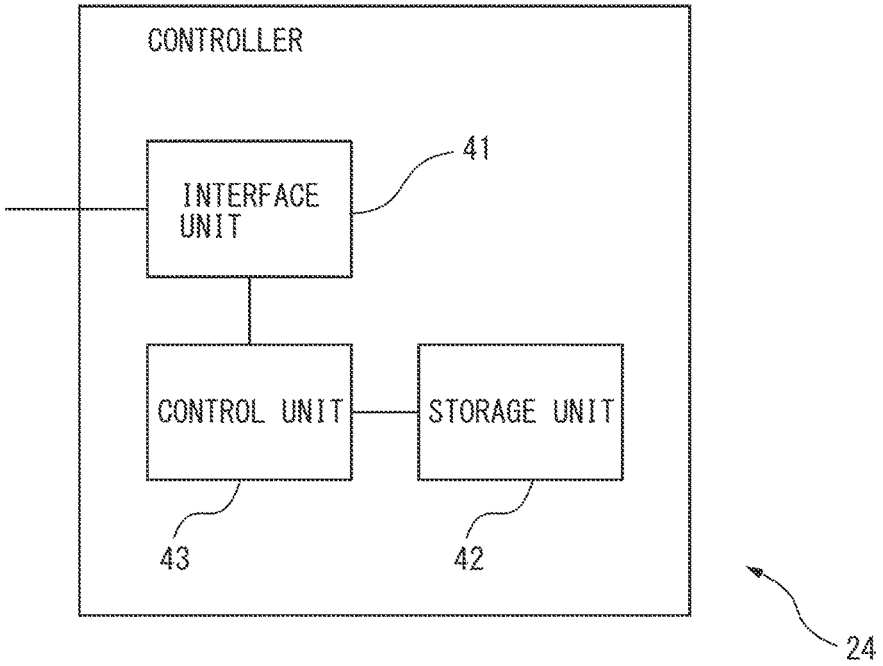
FIG. 25 is a diagram schematically illustrating the configuration of a controller.

FIG. 25 is a diagram schematically illustrating the configuration of the controller 24. The controller 24 includes an interface nit 41, a storage unit 42, and a control unit 43.

The interface unit 41 is a communication interface for the controller 24 to communicate with the reader/writer 23, and may be, for example, an interface conforming to USB, in common with the interface unit 32 of the reader/writer 23. When a control command such as a query signal transmit command is received from the control unit 43, the interface unit 41 outputs the command to the reader/writer 23. When the measurement result signal is received from the reader/writer 23, the interface unit 41 passes it to the control unit 43.

The storage unit 42 includes, for example, a nonvolatile semiconductor memory or a hard disk device or the like. The storage unit 42 stores, for example, the transmit power value of the radio wave in response to which the response signal from the RFID tag 10 has been received successfully. The storage unit 42 also stores the transmit power value as the fail/pass criteria value of the RFID tag 10.

The control unit 43 is one example of a testing unit, and includes at least one processor and its peripheral circuitry. The control unit 43 controls each unit of the controller 24. Further, the control unit 43 determines whether the RFID tag 10 is defective or non-defective, based on the result of a comparison between the fail/pass criteria value and the minimum value of the transmit power of the radio wave radiated from the reader/writer 23 when the reader/writer 23 has successfully received the response signal from the RFID tag 10. A description will be given below by dealing with the case where one kind of frequency characteristic adjusting jig, for example, a frequency characteristic adjusting jig of length 12 for shifting the frequency characteristic of the loop antenna from the frequency f2 to the frequency ft, is used as the frequency characteristic adjusting jig 22.

Figure 26:
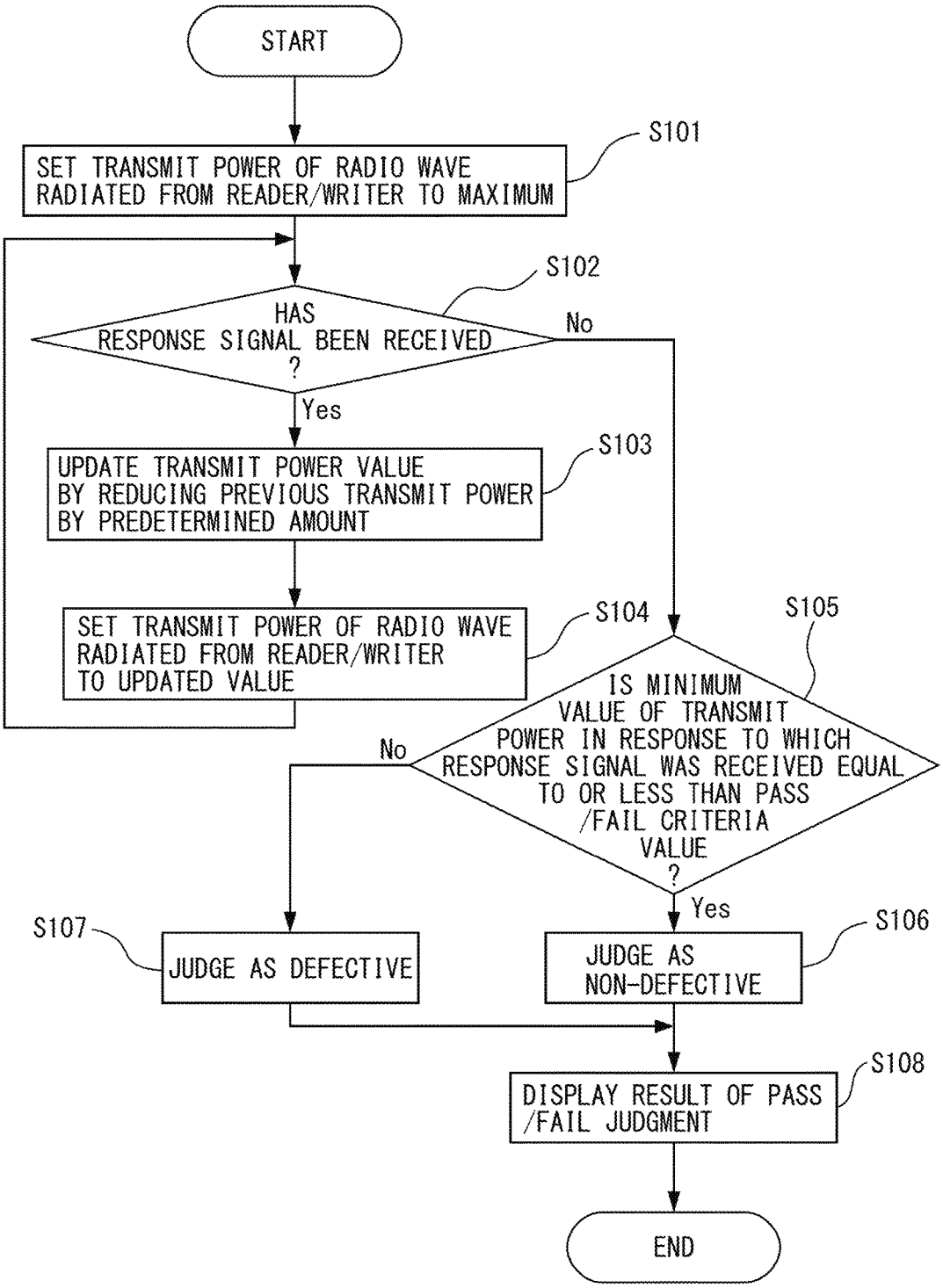
FIG. 26 is an operation flowchart of an antenna testing procedure.

FIG. 26 is an operation flowchart of an antenna testing procedure which is carried out by the antenna testing apparatus 20.

When the testing of the RFID tag 10 is started in response to an operation signal from an operating unit (not depicted), the control unit 43 first creates a transmit command instructing that the transmit power of the radio wave radiated from the reader/writer 23 be set to a maximum. The control unit 43 transmits the transmit command to the reader/writer 23 via the interface unit 41 (step S101). Then, by referring to the measurement result signal received from the reader/writer 23, the control unit 43 determines whether the reader/writer 23 has successfully received the response signal from the RFID tag 10 at the specified transmit power value (step S102). When the reader/writer 23 has successfully received the response signal (Yes in step S102), the control unit 43 stores the corresponding transmit power value in the storage unit 42. Further, the control unit 43 updates the specified transmit power value by reducing the previously specified transmit power by a predetermined amount (step S103). Then, the control unit 43 creates a transmit command specifying the updated transmit power value, and transmits the transmit command to the reader/writer 23 via the interface unit 41 (step S104). After that, the control unit 43 repeats the process starting from step S102.

On the other hand, if the measurement result signal indicates that the reader/writer 23 failed to receive the response signal from the RFID tag 10 at the specified transmit power value (No in step S102), it is determined that the transmit power value corresponding to the previous measurement is the minimum value of the transmit power needed for communication. Then, the control unit 43 checks to see if the minimum value of the transmit power stored in the storage unit 42 is equal to or less than the pass/fail criteria value (step S105). If the minimum value is equal to or less than the pass/fail criteria value (Yes in step S105), the control unit 43 judges the RFID tag 10 as non-defective (step S106). On the other hand, if the minimum value is larger than the pass/fail criteria value, or if the reader/writer 23 failed to receive the response signal even at the maximum value of the transmit power (No in step S105), the control unit 43 judges the RFID tag 10 as defective (step S107).

The control unit 43 displays the result of the pass/fail judgment of the RFID tag 10 on a display device (not depicted) connected to the controller 24 (step S108). Alternatively, the control unit 43 may output the result of the pass/fail judgment of the RFID tag 10 via an interface unit (not depicted) to some other device connected to the controller 24.

The control unit 43 may carry out the above procedure each time a frequency characteristic adjusting jig having a length for shifting the frequency characteristic of the loop antenna from a designated one of the frequencies f1, f2, and f3 to the frequency ft is attached to the RFID tag 10. Then, if the minimum value of the transmit power is higher than the pass/fail criteria value for any one of the frequencies f1, f2, and f3, the control unit 43 may judge the RFID tag 10 as defective. In this case, the pass/fail criteria value may be set for each one of the frequencies f1, f2, and f3.

Alternatively, the control unit 43 may specify the transmit power value by the first transmit command to be the minimum value that the reader/writer 23 can set. Then, the control unit 43 may gradually increase the specified transmit power value until the reader/writer 23 can receive the response signal from the RFID tag 10. Then, the control unit 43 may determine that the specified transmit power value when the reader/writer 23 first succeeded in receiving the response signal from the RFID tag 10 is the minimum value of the transmit power needed for communication with the RFID tag 10.

As has been described above, by attaching the frequency characteristic adjusting jig to a loop antenna having a three-dimensional shape, the frequency characteristic of the loop antenna can be shifted toward higher or lower frequencies. Therefore, the antenna testing apparatus using the frequency characteristic adjusting jig can test the loop antenna by using a radio wave having a frequency outside the operating frequency range of the loop antenna.

The present invention is not limited to any particular embodiment described above. In the antenna testing apparatus, the reader/writer and the controller may be combined into one unit. In that case, the reader/writer, for example, includes a storage unit, and the storage unit is used to store the pass/fail criteria value, etc. Then, the control unit in the reader/writer determines whether the RFID tag is defective or non-defective, based on the result of a comparison between the fail/pass criteria value and the minimum power value of the radio wave output from the reader/writer when the reader/writer 23 successfully received the response signal from the RFID tag incorporating the loop antenna under test.

Further, the shape of the loop antenna to which the frequency characteristic adjusting jig is attached is not limited to the particular one depicted in FIG. 1. For example, the loop antenna to which the frequency characteristic adjusting jig is attached may be formed so that the loop is substantially square, substantially circular, or substantially triangular in shape. In such cases also, the frequency characteristic adjusting jig need only be formed so that the first and second members of the frequency characteristic adjusting jig are disposed along the outer periphery of the loop so as to conform with the shape of the loop and to be electromagnetically coupled or electrically connected to the conductor forming the loop antenna. In this case also, the amount by which the frequency characteristic is to be shifted is adjusted by choosing the length of the first and second members along the loop.

The loop antenna may be used by being permanently equipped with the frequency characteristic adjusting jig according to any one of the above embodiments or modified example. In this case, the loop antenna can be used with its frequency characteristic shifted according to the length L of the frequency characteristic adjusting jig attached to it.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority and inferiority of the invention. Although the embodiments of the present invention have been described in detail, it should be understood that the various changes, substitutions, and alterations could be made hereto without departing from the spirit and scope of the invention.

What is claimed is:

1. A frequency characteristic adjusting jig to be attached to a loop antenna including a conductor that is formed in the shape of a loop such that a width measured in a direction perpendicular to a plane of the loop is larger than a width measured in the plane of the loop and that includes a feed point formed in a portion of the loop, the frequency characteristic adjusting jig comprising:

a conductive first member which, when the frequency characteristic adjusting jig is attached to the loop antenna, is located along an outer periphery of the loop for a portion of the conductor and is electromagnetically coupled or electrically connected to the portion of the conductor;

a conductive second member which, when the frequency characteristic adjusting jig is attached to the loop antenna, is located along the outer periphery of the loop for another portion of the conductor and is electromagnetically coupled or electrically connected to the other portion of the conductor; and a conductive third member which connects the first and second members together via a different path than a path formed along the loop, wherein the first and second members are chosen to have a length along the loop such that a frequency characteristic of the loop antenna is shifted according to the length.

2. The frequency characteristic adjusting jig according to claim 1, wherein the loop of the loop antenna is formed in a rectangular shape, and wherein when the frequency characteristic adjusting jig is attached to the loop antenna, the first member is located so as to face one of two long sides of the rectangular loop, the one long side being the portion of the conductor, when the frequency characteristic adjusting jig is attached to the loop antenna, the second member is located so as to face the other of the two long sides of the rectangular loop, the other long side being the other portion of the conductor, and when the frequency characteristic adjusting jig is attached to the loop antenna, the third member is located so as to conform to the loop.

3. The frequency characteristic adjusting jig according to claim 2, wherein when the frequency characteristic adjusting jig is attached to the loop antenna, the third member connects an end portion of the first member located farther from a first short side, which, of two short sides of the loop, is nearer to the first and second members, to an end portion of the second member located farther from the first short side.

4. The frequency characteristic adjusting jig according to claim 3, further comprising a conductive fourth member which faces the first short side when the frequency characteristic adjusting jig is attached to the loop antenna.

5. The frequency characteristic adjusting jig according to claim 3, wherein one of the two long sides of the loop antenna is provided with the feed point, and wherein the first and second members are formed so that the length of the first and second members along the long side is shorter than the length from the first short side to the feed point when the frequency characteristic adjusting jig is attached to the loop antenna.

6. The frequency characteristic adjusting jig according to claims 1, further comprising a connecting portion for electrically connecting to another frequency characteristic adjusting jig attached to a different position on the loop antenna.

7. A loop antenna comprising:

a conductor which is formed in the shape of a loop such that a width measured in a direction perpendicular to a plane of the loop is larger than a width measured in the plane of the loop, and which includes a feed point formed in a portion of the loop;

a conductive first member which is located along an outer periphery of the loop for a portion of the conductor, and which is electromagnetically coupled or electrically connected to the portion of the conductor;

a conductive second member which is located along the outer periphery of the loop for another portion of the conductor, and which is electromagnetically coupled or electrically connected to the other portion of the conductor; and a conductive third member which connects the first and second members together via a different path than a path formed along the loop, wherein the first and second members are chosen to have a length along the loop such that a frequency characteristic of the loop antenna is shifted according to the length.

8. An antenna testing apparatus for testing a loop antenna including a conductor that is formed in the shape of a loop such that a width measured in a direction perpendicular to a plane of the loop is larger than a width measured in the plane of the loop and that includes a feed point formed in a portion of the loop, the antenna testing apparatus comprising:

a frequency characteristic adjusting jig to be attached to the loop antenna;

a reader/writer configured to radiate, toward the loop antenna to which the frequency characteristic adjusting jig is attached, a radio wave having a second frequency different from a first frequency at which the loop antenna is designed to operate, and thereby measure a metric relating to communication performance of the loop antenna at the second frequency; and a processor configured to obtain a test result of the loop antenna based on the metric, and wherein the frequency characteristic adjusting jig comprises:

a conductive first member which, when the frequency characteristic adjusting jig is attached to the loop antenna, is located along an outer periphery of the loop for a portion of the conductor and is electromagnetically coupled or electrically connected to the portion of the conductor;

a conductive second member which, when the frequency characteristic adjusting jig is attached to the loop antenna, is located along the outer periphery of the loop for another portion of the conductor and is electromagnetically coupled or electrically connected to the other portion of the conductor; and a conductive third member which connects the first and second members together via a different path than a path formed along the loop, wherein the first and second members are chosen to have a length along the loop such that a frequency characteristic of the loop antenna is shifted from the first frequency to the second frequency.

9. The antenna testing apparatus according to claim 8, wherein the loop antenna is incorporated in a tag which, when the radio wave having the second frequency is received via the loop antenna, radiates a response radio wave from the loop antenna by superimposing thereon a signal responding to the received radio wave, and the reader/writer radiates the radio wave having the second frequency while varying transmit power, and receives the response radio wave and thereby measures as the metric a minimum value of the transmit power in response to which the response radio wave was received.

10. The antenna testing apparatus according to claim 9, wherein the processor further configured to judge the loop antenna as non-defective when the minimum value of the transmit power is equal to or less than a predetermined criteria value, judge the loop antenna as defective when the minimum value of the transmit power is larger than the predetermined criteria value, and produce the test result indicating whether the loop antenna is non-defective or defective.

11. An antenna testing method for testing a loop antenna including a conductor that is formed in the shape of a loop such that a width measured in a direction perpendicular to a plane of the loop is larger than a width measured in the plane of the loop and that includes a feed point formed in a portion of the loop, the antenna testing method comprising:

transmitting, by a reader/writer, toward the loop antenna to which a frequency characteristic adjusting jig is attached, a radio wave having a second frequency different from a first frequency at which the loop antenna is designed to operate;

measuring, by the reader/writer, a metric relating to communication performance of the loop antenna at the second frequency; and obtaining, by a processor, a test result of the loop antenna based on the metric, and wherein the frequency characteristic adjusting jig comprises:

a conductive first member which, when the frequency characteristic adjusting jig is attached to the loop antenna, is located along an outer periphery of the loop for a portion of the conductor and is electromagnetically coupled or electrically connected to the portion of the conductor;

a conductive second member which, when the frequency characteristic adjusting jig is attached to the loop antenna, is located along the outer periphery of the loop for another portion of the conductor and is electromagnetically coupled or electrically connected to the other portion of the conductor; and a conductive third member which connects the first and second members together via a different path than a path formed along the loop, wherein the first and second members are chosen to have a length along the loop such that a frequency characteristic of the loop antenna is shifted from the first frequency to the second frequency.

12. The antenna testing method according to claim 11, wherein the loop antenna is incorporated in a tag which, when the radio wave having the second frequency is received via the loop antenna, radiates a response radio wave from the loop antenna by superimposing thereon a signal responding to the received radio wave, and the transmitting the radio wave radiates the radio wave having the second frequency while varying transmit power; and the measuring the metric receives the response radio wave and thereby measures as the metric a minimum value of the transmit power in response to which the response radio wave was received.

13. The antenna testing method according to claim 12, wherein the obtaining the test result of the loop antenna judges the loop antenna as non-defective when the minimum value of the transmit power is equal to or less than a predetermined criteria value, while judges the loop antenna as defective when the minimum value of the transmit power is larger than the predetermined criteria value, and produces the test result indicating whether the loop antenna is non-defective or defective.

* * * * *